US011078042B2

(12) United States Patent
Ogawa

(10) Patent No.: US 11,078,042 B2
(45) Date of Patent: Aug. 3, 2021

(54) PRINTING APPARATUS AND PRINTING METHOD

(71) Applicant: CANON KABUSHIKI KAISHA, Tokyo (JP)

(72) Inventor: Katsuya Ogawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 16/391,895

(22) Filed: Apr. 23, 2019

(65) Prior Publication Data

US 2019/0330004 A1 Oct. 31, 2019

(30) Foreign Application Priority Data

Apr. 27, 2018 (JP) ..... JP2018-087526

(51) Int. Cl.

| | |
|---|---|
| ***B65H 29/66*** | (2006.01) |
| ***B65H 29/20*** | (2006.01) |
| ***B65H 5/06*** | (2006.01) |
| ***B41J 13/00*** | (2006.01) |
| ***B41J 11/00*** | (2006.01) |
| ***B41J 2/045*** | (2006.01) |

(52) U.S. Cl.

CPC ..... *B65H 29/6609* (2013.01); *B41J 2/04573* (2013.01); *B41J 11/008* (2013.01); *B41J 13/0027* (2013.01); *B65H 5/068* (2013.01); *B65H 29/20* (2013.01); *B65H 2301/444* (2013.01)

(58) Field of Classification Search

CPC ... B41J 13/0027; B41J 2/04573; B41J 11/008

See application file for complete search history.

(56) References Cited

U.S. PATENT DOCUMENTS 9,333,773 B2 * 5/2016 Taniguchi ..... B41J 13/0009
2015/0368055 A1 12/2015 Kunihiro et al.

FOREIGN PATENT DOCUMENTS

EP 1475235 A1 * 11/2004 ..... B41J 2/2128

* cited by examiner

*Primary Examiner* — Julian D Huffman

(74) *Attorney, Agent, or Firm* — Canon U.S.A., Inc. IP Division

(57) ABSTRACT

A printing apparatus conveys preceding and following sheets to form an overlapping portion where a trailing edge of the preceding sheet and a leading edge of the following sheet overlap each other at a printing position facing an ejection port surface of a printing unit, and prints the preceding and following sheets by ejecting ink from ejection ports based on a relative movement between the printing unit and the preceding and following sheets. The printing unit delays ink ejection timing for printing the overlapping portion of a sheet located closer to the ejection port surface at a position facing the ejection ports from ink ejection timing for printing a non-overlapping portion where the preceding sheet and the following sheet do not overlap each other in one of the preceding sheet and the following sheet.

20 Claims, 20 Drawing Sheets

(A0)

(A1)

(A2)

(B0)

(B1)

(B2)

(A1)

(A2)

(B1)

(B2)

FIG.19A
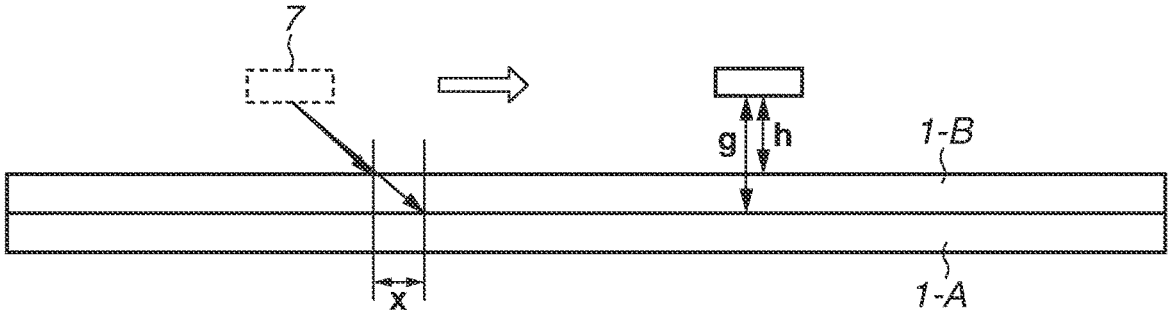
FIG.19B
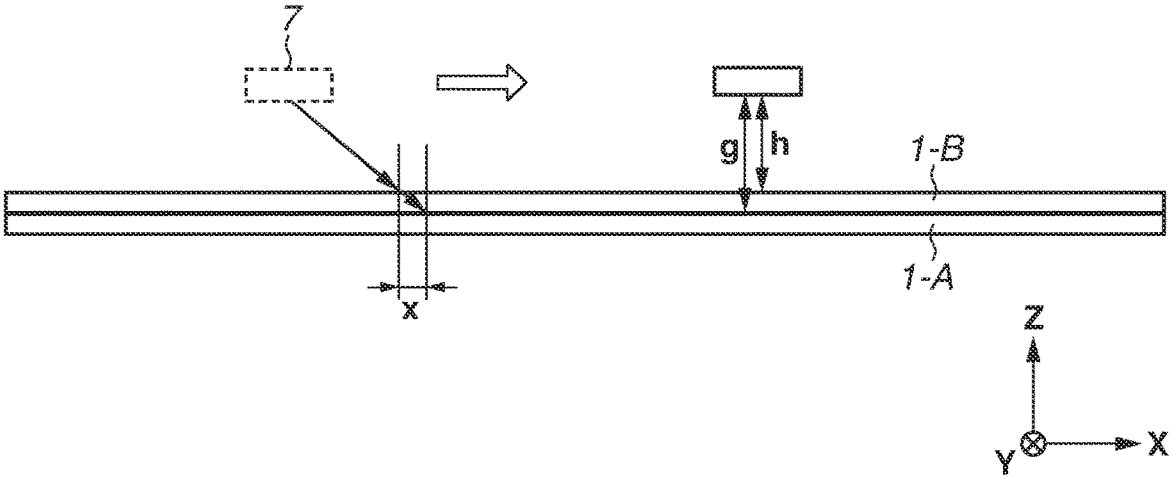
FIG.19C
| SHEET TYPE | CORRECTION VALUE (2400 dpi) |
|---|---|
| PLAIN PAPER (THICK PAPER) | 2 |
| PLAIN PAPER (THIN PAPER) | 1 |

PRINTING APPARATUS AND PRINTING METHOD

BACKGROUND OF THE INVENTION

Field of the Invention

The present invention relates to a printing apparatus and a printing method for printing a sheet with a print head.

Description of the Related Art

In a printing apparatus that continuously prints a plurality of sheets, it is effective to improve a printing throughput to reduce a time from completion of printing of a preceding print sheet until start of printing of a following print sheet.

United States Patent Application Publication No. 2015/0368055 discusses a printing apparatus that conveys a preceding sheet and a following sheet that overlaps the preceding sheet to a position facing a printing unit, and performs printing in a state where the sheets overlap each other.

However, in the apparatus discussed in United States Patent Application Publication No. 2015/0368055, the distance between the printing unit and the upper surface of one sheet placed on the other sheet when the printing unit faces an overlapping portion of the preceding sheet and the following sheet is smaller than the distance between the printing unit and the upper surface of one of the sheets when the printing unit faces a non-overlapping portion.

Accordingly, in a case where an image is to be formed by ejecting ink onto a print sheet from the printing unit while the printing unit and the print medium are moved relatively to each other, a time required for an ejected ink droplet to land on a printing surface at the overlapping portion of the print sheets is different from that at the non-overlapping portion. As a result, the position where an image is formed with ink deviates in the direction of the relative movement, and for this reason, an image with high image quality cannot be obtained.

SUMMARY OF THE INVENTION

The present invention has been made in view of the above-described issues and is directed to obtaining an excellent printed image while performing printing with a high throughput.

According to embodiments of the present invention, a printing apparatus includes a printing unit including an ejection port surface provided with a plurality of ejection ports for ejecting ink arrayed in a predetermined direction and configured to print a sheet by ejecting ink while moving over the sheet in a movement direction intersecting with the predetermined direction, and a conveyance unit configured to convey a sheet in a direction intersecting with the movement direction and to convey a preceding sheet and a following sheet in such a manner that an overlapping portion where a trailing edge of the preceding sheet and a leading edge of the following sheet overlap each other is formed at a printing position facing the ejection port surface of the printing unit, wherein in a case where the printing unit prints, in a same movement, the overlapping portion of a sheet located closer to the ejection port surface and a non-overlapping portion of one of the preceding sheet and the following sheet where the preceding sheet and the following sheet do not overlap each other, the printing unit delays ink ejection timing according to the movement of the printing unit by a part of the plurality of ejection ports for printing the overlapping portion from ink ejection timing according to the movement of the printing unit by another part of the plurality of ejection ports for printing the non-overlapping portion of the sheet.

Further features of the present invention will become apparent from the following description of exemplary embodiments with reference to the attached drawings.

BRIEF DESCRIPTION OF THE DRAWINGS

FIGS. 19A to 19C each illustrate a table for correcting the landing position of the recording material according to the present exemplary embodiment.

DESCRIPTION OF THE EMBODIMENTS

A first exemplary embodiment of the present invention will be described in detail below with reference to the accompanying drawings.

Figure 1:
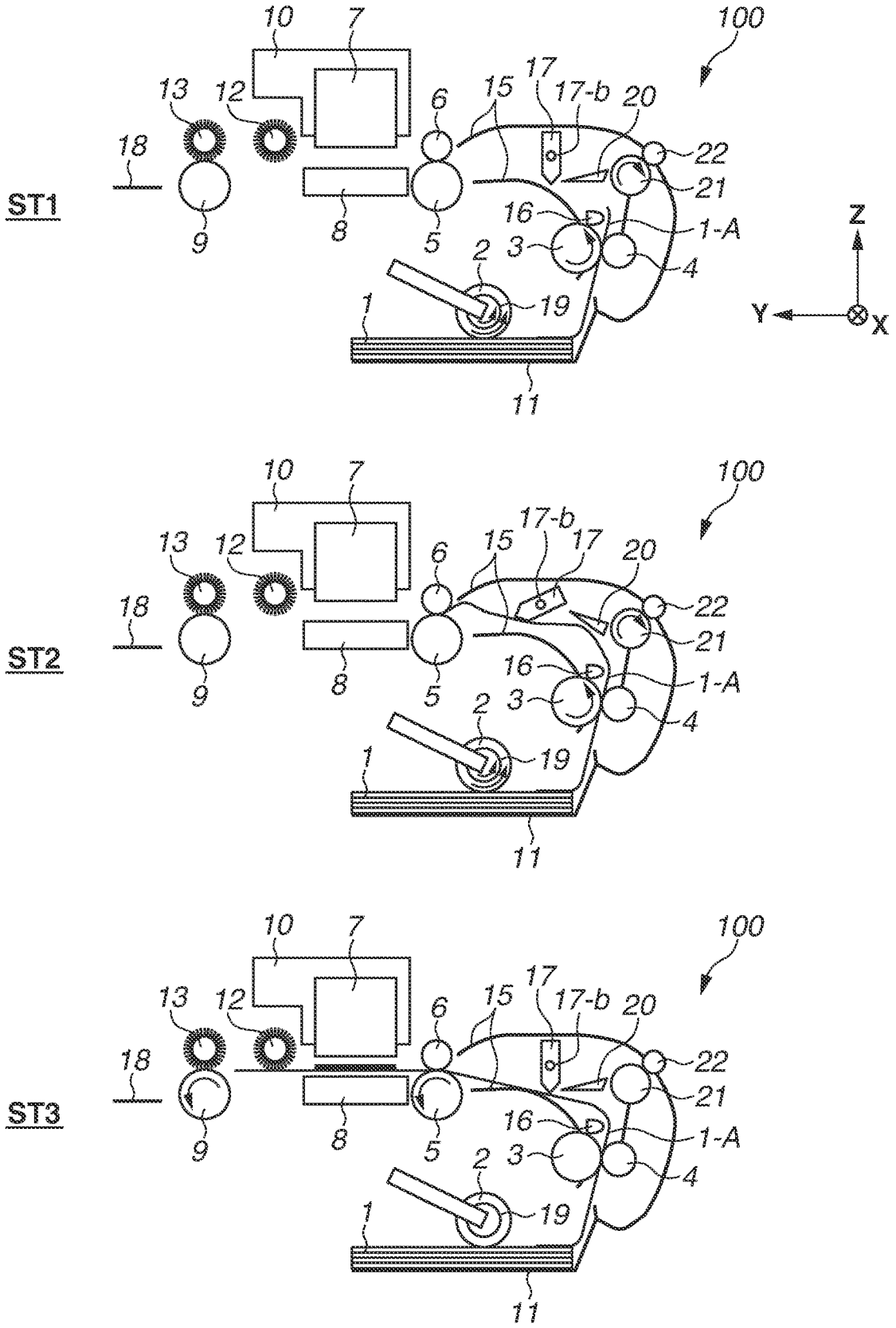
FIG. 1 is a schematic diagram illustrating an overlap continuous feeding operation in a printing apparatus according to an exemplary embodiment of the present invention.
Figure 2:
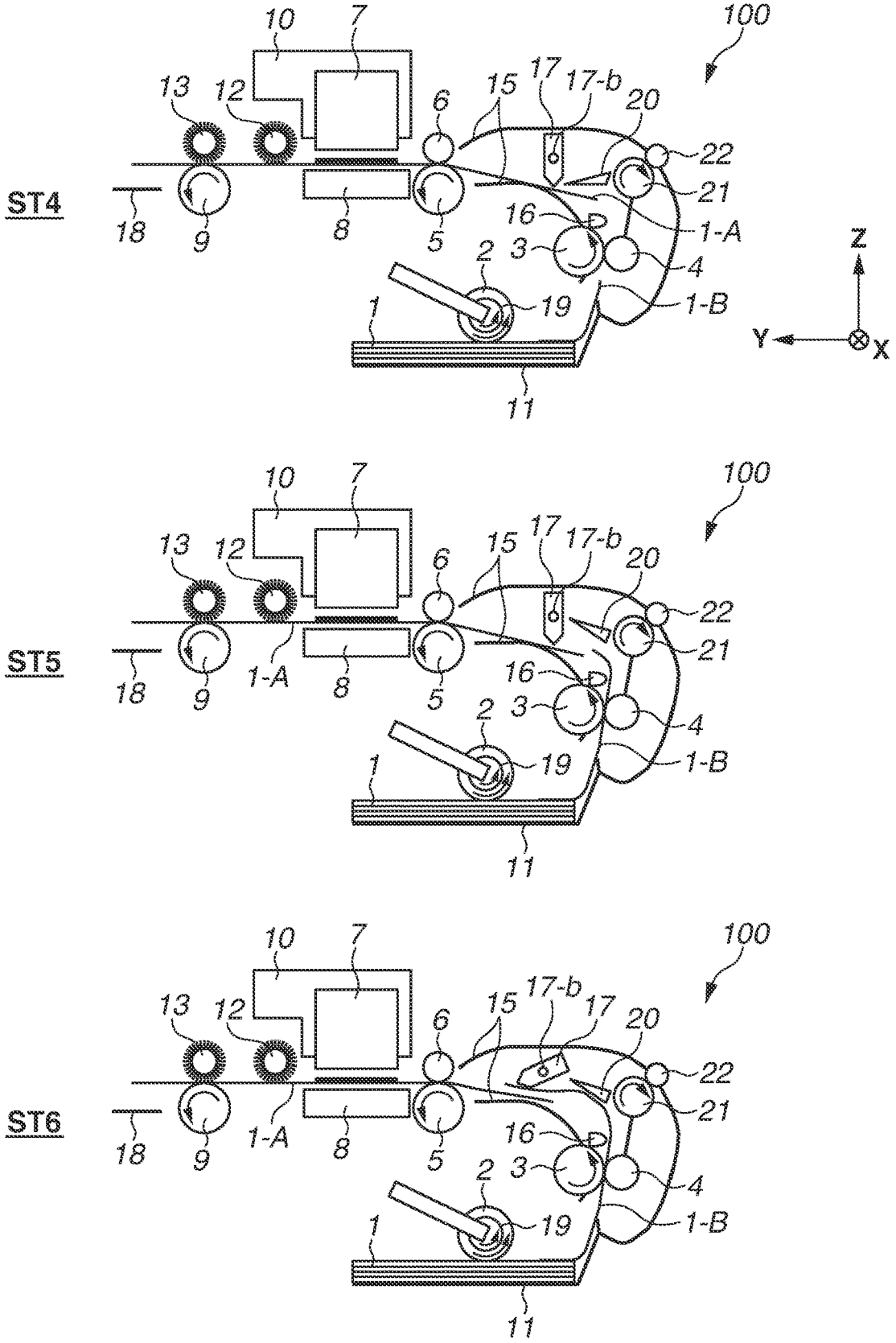
FIG. 2 is a schematic diagram illustrating the overlap continuous feeding operation in the printing apparatus according to the present exemplary embodiment.
Figure 3:
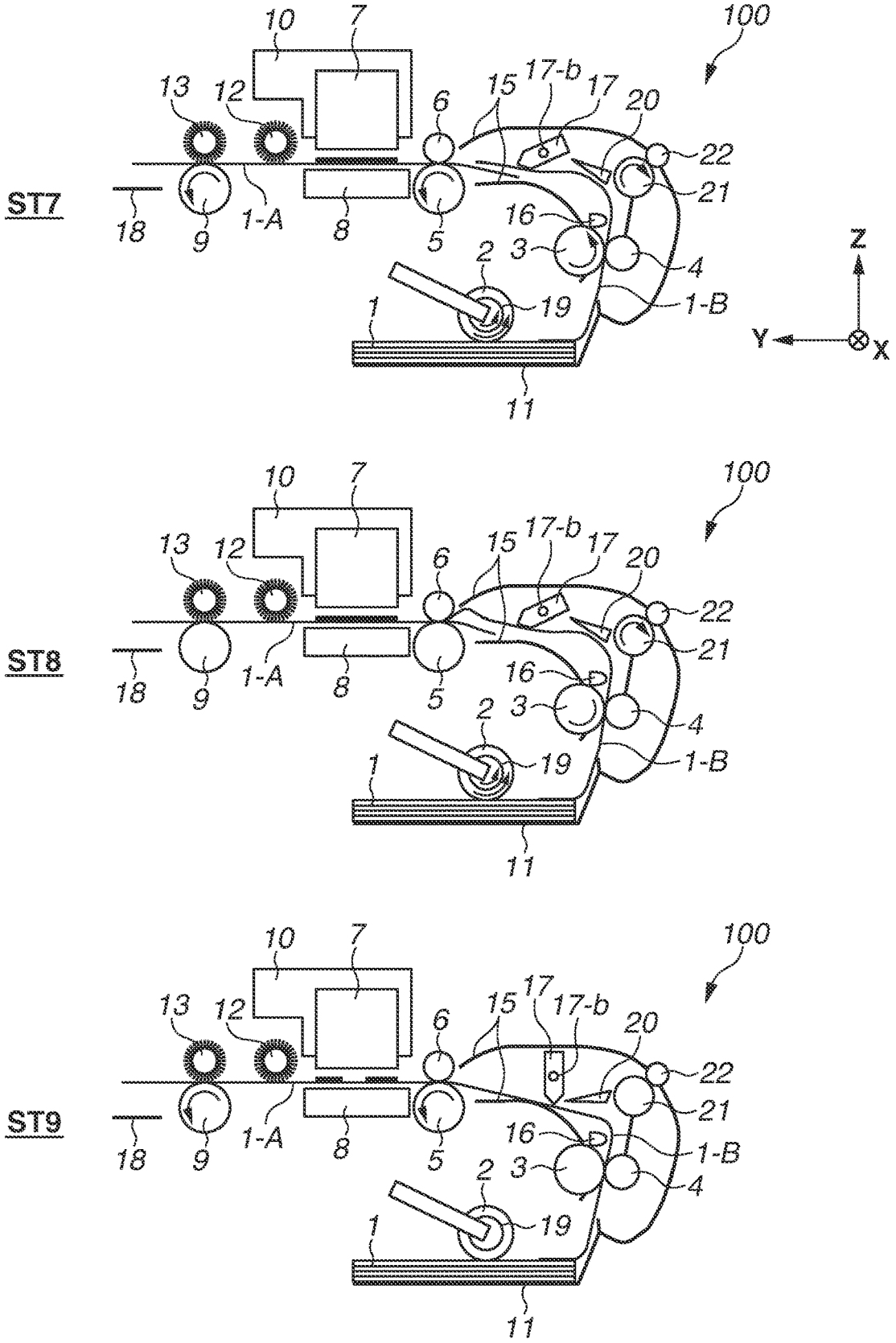
FIG. 3 is a schematic diagram illustrating an operation for printing a preceding sheet and a following sheet in one movement in the overlap continuous feeding operation in the printing apparatus according to the present exemplary embodiment.

FIGS. 1 to 3 are schematic diagrams each illustrating a printing apparatus according to the present exemplary embodiment of the present invention, and also illustrating an internal state of the printing apparatus when the inside of the printing apparatus is viewed from a side surface position of the printing apparatus. An overlap continuous feeding operation will be described below. First, the schematic configuration of the printing apparatus according to the present exemplary embodiment will be described with reference to a state ST1 in FIG. 1.

The meaning of the term "print" includes not only formation of significant information, such as a character or a graphic pattern, but also formation of an image, a design, or a pattern on a print medium in a broader sense, or processing of a medium, regardless of whether the information is significant or insignificant, or has become obvious to allow a human to visually perceive the information. In the present exemplary embodiment, it is assumed that sheet-like paper is used as a "print medium", but cloth, a plastic film, or the like may be used instead of paper. A sheet-like print medium is herein referred to as a print sheet.

A configuration of a printing apparatus 100 will be described with reference to the state ST1 in FIG. 1. A plurality of print sheets 1 is stacked on a feeding tray 11 (stacking portion). A pickup roller 2 comes into contact with the uppermost print sheet 1 stacked on the feeding tray 11, and picks up the print sheet 1. A feeding roller 3 feeds the print sheet 1 picked up by the pickup roller 2 to a downstream side in a sheet conveyance direction. A feeding follower roller 4 is urged against the feeding roller 3 and nips the print sheet 1 with the feeding roller 3 to feed the print sheet 1.

A conveyance roller 5 conveys the print sheet 1, which is fed by the feeding roller 3 and the feeding follower roller 4 in a height direction (Z-direction) of the printing apparatus 100, in a +Y direction to a position facing a print head 7. A pinch roller 6 is urged against the conveyance roller 5 and pinches the print sheet 1 with the conveyance roller 5 to convey the print sheet 1.

The print head 7 performs printing while moving relatively to the print sheet 1 conveyed by the conveyance roller 5 and the pinch roller 6. The present exemplary embodiment is described about an inkjet print head for ejecting ink as a recording material from the print head 7 to print the print sheet 1.

A platen 8 supports the back surface of the print sheet 1 at the position facing the print head 7. A carriage 10 has the print head 7 mounted thereon and moves in a direction (X-direction) intersecting with the sheet conveyance direction. The carriage 10 is attached to a guide rail and a guide shaft (not illustrated), and moves in the X-direction along the guide rail and the guide shaft.

A discharge roller 9 discharges the print sheet 1 which has been printed by the print head 7 to the outside of the printing apparatus 100. Spurs 12 and 13 are rotated in contact with the printing surface of the print sheet 1 which has been printed by the print head 7. The spur 13 located on the downstream side is urged against the discharge roller 9, and the spur 12 located on an upstream side is not disposed at the position facing the discharge roller 9. The spur 12 is used to prevent uplift of the print sheet 1, and thus is also referred to as a pressing spur. The discharged print sheet 1 is stacked on a discharge tray (discharge portion) 18.

The print sheet 1 is guided by a conveyance guide 15 between a feeding nip portion formed by the feeding roller 3 and the feeding follower roller 4 and a conveyance nip portion formed by the conveyance roller 5 and the pinch roller 6. A sheet detection sensor 16 detects a leading edge and a trailing edge of the print sheet 1. The sheet detection sensor 16 is provided on the downstream side of the feeding roller 3 in the sheet conveyance direction. A sheet pressing lever 17 is used to place a leading edge of a following sheet on a trailing edge of a preceding sheet. The sheet pressing lever 17 is urged by a spring counterclockwise around a rotation shaft 17*b* in FIG. 1.

Figure 4A:
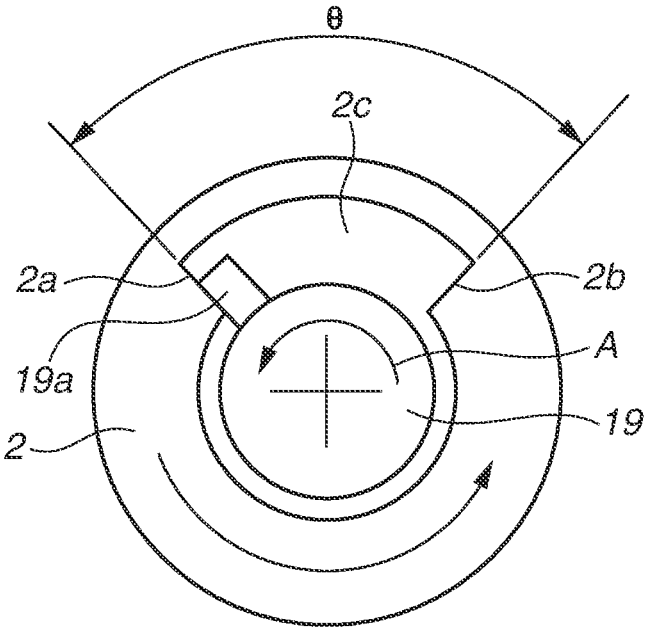
FIGS. 4A and 4B each illustrate a configuration of a pickup roller according to the present exemplary embodiment.
Figure 4B:
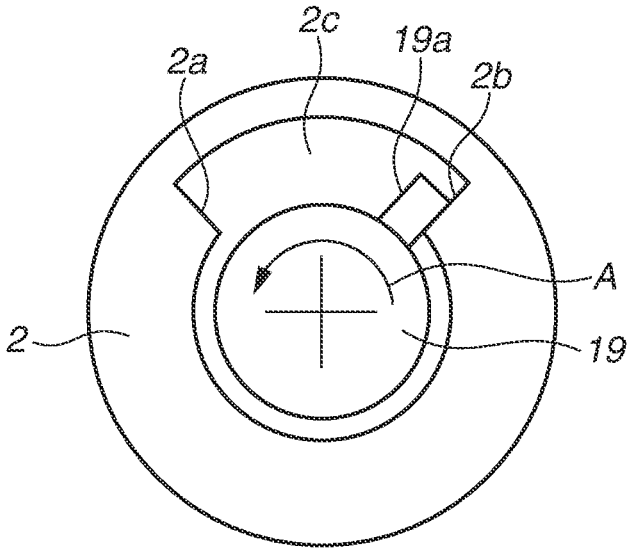

FIGS. 4A and 4B each illustrate the configuration of the pickup roller 2. As described above, the pickup roller 2 comes into contact with the uppermost print sheet 1 stacked on the feeding tray 11 and picks up the print sheet 1. A drive shaft 19 transmits a driving force from a feeding motor, which is described below, to the pickup roller 2. When the print sheet 1 is picked up, the drive shaft 19 and the pickup roller 2 are rotated in a direction indicated by an arrow "A" in FIGS. 4A and 4B. The drive shaft 19 is provided with a protrusion 19*a*. The pickup roller 2 is provided with a recess 2*c* into which the protrusion 19*a* is fit. As illustrated in FIG. 4A, when the protrusion 19*a* is in contact with a first surface 2*a* of the recess 2*c* of the pickup roller 2, the driving force from the drive shaft 19 is transmitted to the pickup roller 2, and when the drive shaft 19 is driven, the pickup roller 2 is rotated. On the other hand, as illustrated in FIG. 4B, when the protrusion 19*a* is in contact with a second surface 2*b* of the recess 2*c* of the pickup roller 2, the driving force from the drive shaft 19 is not transmitted to the pickup roller 2, and thus, even when the drive shaft 19 is driven, the pickup roller 2 is not rotated. In a case where the protrusion 19*a* is in contact with neither the first surface 2*a* nor the second surface 2*b* and the protrusion 19*a* is located between the first surface 2*a* and the second surface 2*b*, the pickup roller 2 is not rotated even when the drive shaft 19 is driven.

Figure 5:
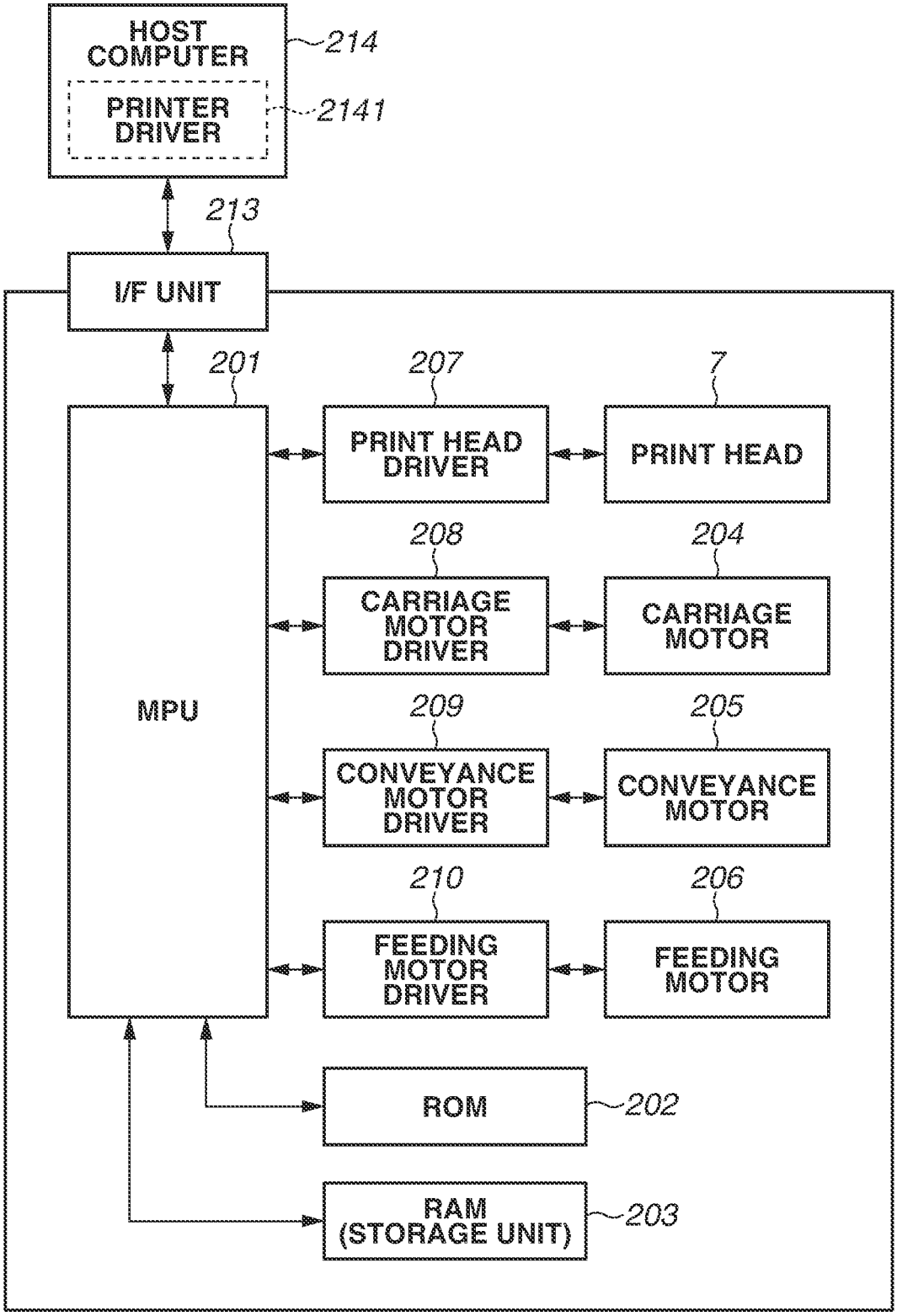
FIG. 5 is a block diagram illustrating the printing apparatus according to the present exemplary embodiment.

FIG. 5 is a block diagram illustrating the printing apparatus 100 according to the present exemplary embodiment. A micro processing unit (MPU) 201 controls operations of each unit, data processing, and the like. The MPU 201 also functions as a unit that controls the conveyance of print sheets in such a manner that, as described below, a leading edge of a following sheet 1-B is placed on a trailing edge of a preceding sheet 1-A. A read-only memory (ROM) stores programs and data to be executed by the MPU 201. A random access memory (RAM) 203 temporarily stores processed data to be executed by the MPU 201 and data received from a host computer 214.

The print head 7 includes ink ejection ports and printing elements, such as heating elements or piezoelectric elements, which generate energy for ejecting ink, and is controlled by a print head driver 207. A plurality of printing elements and a plurality of ejection ports respectively corresponding to the plurality of printing elements are prepared. The plurality of printing elements and the plurality of ejection ports are arrayed in a predetermined direction (Y-direction in this case). A carriage motor 204 that drives the carriage 10 is controlled by a carriage motor driver 208. An encoder scale is attached along the guide shaft that allows the carriage 10 to move. When a signal indicating that a slit of the encoder scale is detected using a sensor mounted on the carriage 10 is sent to the MPU 201, the MPU 201 sends information about the detected slit to the print head driver 207. The print head driver 207 generates a drive signal serving as a reference for timing at which the print head 7 ejects ink, and drives the printing elements so that the print head 7 continuously ejects ink at a time interval of about one microsecond in accordance with a movement of the carriage 10, i.e., a movement of the print head 7.

The conveyance roller 5 and the discharge roller 9 are driven by a conveyance motor 205. The conveyance motor 205 is controlled by a conveyance motor driver 209. The pickup roller 2 and the feeding roller 3 are driven by a feeding motor 206. The feeding motor 206 is controlled by a feeding motor driver 210.

The host computer 214 is provided with a printer driver 2141 for collecting printing information, such as an image to be printed and print image quality, to communicate with the printing apparatus 100 when an instruction to execute a printing operation is sent from a user. The MPU 201 executes exchange of the image to be printed and the like with the host computer 214 via an interface (I/F) unit 213.

Operation Examples

The overlap continuous feeding operation will be described in chronological order with reference to the state ST1 in FIG. 1 to a state ST9 in FIG. 3. Each of X, Y, and Z in FIG. 3 represents a directional axis when the printing apparatus 100 is placed on a horizontal place. The Y-axis and the Z-axis are perpendicular to each other, and the X-axis is perpendicular to a plane formed by the Y-axis and the Z-axis. When print data is transmitted from the host computer 214 via the IN unit 213, the print data is processed by the MPU 201 and is then loaded into the RAM 203. The printing operation is started based on the data loaded into the MPU 201.

The overlap continuous feeding operation will be described with reference to the state ST1 in FIG. 1. First, the feeding motor driver 210 drives the feeding motor 206 at a low speed. As a result, the pickup roller 2 is rotated at 7.6 inches/sec. When the pickup roller 2 is rotated, the uppermost print sheet (preceding sheet 1-A) stacked on the feeding tray 11 is picked up. The preceding sheet 1-A picked up by the pickup roller 2 is conveyed by the feeding roller 3 that is rotated in the same direction as the pickup roller 2. The feeding roller 3 is also driven by the feeding motor 206. The present exemplary embodiment illustrates a structure including the pickup roller 2 and the feeding roller 3. However, a structure including only the feeding roller 3 that feeds a print sheet stacked on the stacking portion may be employed.

When the leading edge of the preceding sheet 1-A is detected by the sheet detection sensor 16 provided on the downstream side of the feeding roller 3, a mode of the feeding motor 206 is changed to a high-speed driving mode. Specifically, the pickup roller 2 and the feeding roller 3 are rotated at 20 inches/sec.

The overlap continuous feeding operation will be described with reference to the state ST2 in FIG. 1. The feeding roller 3 is continuously rotated to thereby cause the leading edge of the preceding sheet 1-A to rotate the sheet pressing lever 17 clockwise around the rotation shaft 17*b* against the urging force of the spring. When the feeding roller 3 is further rotated, the leading edge of the preceding sheet 1-A contacts the conveyance nip portion formed by the conveyance roller 5 and the pinch roller 6. At this time, the conveyance roller 5 is stopped. Even after the leading edge of the preceding sheet 1-A contacts the conveyance nip portion, the feeding roller 3 is rotated by a predetermined amount, so that skew of the sheets is corrected by aligning the sheets while the leading edge of the preceding sheet 1-A is in contact with the conveyance nip portion. This skew correction operation is also referred to as a registration operation.

The overlap continuous feeding operation will be described with reference to the state ST3 in FIG. 1. After the skew correction operation on the preceding sheet 1-A ends, the conveyance motor 205 is driven and the conveyance roller 5 thus starts to be rotated. The conveyance roller 5 conveys sheets at 15 inches/sec. After the leading edge of the preceding sheet 1-A is aligned at the position facing the print head 7, the printing operation is performed by ejecting ink from the print head 7 that moves in the X-direction based on print data. The moving direction of the print head 7 is perpendicular to the conveyance direction (Y-direction) of the print medium, although a slight allowable error is included. The leading-edge aligning operation is performed by bringing the leading edge of the print sheet 1 into contact with the conveyance nip portion to temporarily position the print sheet 1 at the position of the conveyance roller 5 and by controlling the rotation amount of the conveyance roller 5 with reference to the position of the conveyance roller 5.

The printing apparatus 100 according to the present exemplary embodiment is a serial-type printing apparatus in which the print head 7 is mounted on the carriage 10. A conveyance operation is performed by causing the conveyance roller 5 to intermittently convey the print sheet 1 by a predetermined amount. When the conveyance roller 5 is stopped, an image forming operation is performed by ejecting ink from the print head 7 while moving the carriage 10 on which the print head 7 is mounted. The conveyance operation and the image forming operation are repeated to print the print sheet 1.

When the leading edge of the preceding sheet 1-A is aligned, the mode of the feeding motor 206 is changed to a low-speed driving mode. Specifically, the pickup roller 2 and the feeding roller 3 are rotated at 7.6 inches/sec. When the conveyance roller 5 is intermittently conveying the print sheet 1 by a predetermined amount, the feeding motor 206 is intermittently driving the feeding roller 3. Specifically, when the conveyance roller 5 is rotated, the feeding roller 3 is also rotated, and when the conveyance roller 5 stops, the feeding roller 3 also stops. The rotation speed of the feeding roller 3 is lower than the rotation speed of the conveyance roller 5. Accordingly, the print sheet 1 is stretched between the conveyance roller 5 and the feeding roller 3. The feeding roller 3 is rotated together with the print sheet 1 conveyed by the conveyance roller 5.

Since the feeding motor 206 is intermittently driven, the drive shaft 19 is also driven. As described above, the rotation speed of the pickup roller 2 is lower than the rotation speed of the conveyance roller 5. Accordingly, the pickup roller 2 is rotated together with the print sheet 1 conveyed by the conveyance roller 5. In other words, the pickup roller 2 is rotated ahead of the drive shaft 19. Specifically, the protrusion 19*a* of the drive shaft 19 is spaced apart from the first surface 2*a* and is in contact with the second surface 2*b*. Accordingly, the second print sheet (following sheet 1-B) is not picked up immediately after the trailing edge of the preceding sheet 1-A passes by the pickup roller 2. After the drive shaft 19 is driven for a predetermined time, the protrusion 19*a* contacts the first surface 2*a* and the pickup roller 2 starts to be rotated.

The overlap continuous feeding operation will be described with reference to the state ST4 in FIG. 2. FIG. 2 illustrates a state where the pickup roller 2 starts to be rotated and picks up the following sheet 1-B. Due to a factor such as the responsiveness of the sensor, a predetermined interval or more is needed between sheets in order that the sheet detection sensor 16 detects the edges of each sheet. Specifically, it is necessary to separate the leading edge of the following sheet 1-B from the trailing edge of the preceding sheet 1-A by a predetermined distance so as to provide a predetermined time interval from when the sheet detection sensor 16 detects the trailing edge of the preceding sheet 1-A until the sheet detection sensor 16 detects the leading edge of the following sheet 1-B. To achieve this, the angle of the recess 2*c* of the pickup roller 2 is set to about 70 degrees.

The overlap continuous feeding operation will be described with reference to the state ST5 in FIG. 2. The following sheet 1-B picked up by the pickup roller 2 is conveyed by the feeding roller 3. At this time, the print head 7 is performing the image forming operation on the preceding sheet 1-A based on print data. When the leading edge of the following sheet 1-B is detected by the sheet detection sensor 16, the mode of the feeding motor 206 is changed to the high-speed driving mode. Specifically, the pickup roller 2 and the feeding roller 3 are rotated at 20 inches/sec.

The overlap continuous feeding operation will be described with reference to the state ST6 in FIG. 2. The trailing edge of the preceding sheet 1-A is pressed downward by the sheet pressing lever 17 as indicated by the state ST5 in FIG. 2. The following sheet 1-B is moved at a speed higher than the speed at which the preceding sheet 1-A is moved downstream during the printing operation performed by the print head 7, and as a result, the leading edge of the following sheet 1-B is placed on the trailing edge of the preceding sheet 1-A (ST6 in FIG. 2). Since the printing operation is being performed on the preceding sheet 1-A based on print data, the preceding sheet 1-A is intermittently being conveyed by the conveyance roller 5. On the other hand, after the leading edge of the following sheet 1-B is detected by the sheet detection sensor 16, the feeding roller 3 is continuously rotated at 20 inches/sec, thereby enabling the following sheet 1-B to catch up with the preceding sheet 1-A.

The overlap continuous feeding operation will be described with reference to the state ST7 in FIG. 3. After the leading edge of the following sheet 1-B is placed on the trailing edge of the preceding sheet 1-A, the following sheet 1-B is conveyed by the feeding roller 3 until the leading edge of the following sheet 1-B is stopped at a predetermined position on the upstream side of the conveyance nip. The position of the leading edge of the following sheet 1-B is calculated based on the rotation amount by which the feeding roller 3 has been rotated since the leading edge of the following sheet 1-B is detected by the sheet detection sensor 16, and is controlled based on the calculation result. At this time, the image forming operation is being performed on the preceding sheet 1-A by the print head 7 based on print data.

The overlap continuous feeding operation will be described with reference to the state ST8 in FIG. 3. The conveyance roller 5 is stopped so that the image forming operation (ink ejection operation) is performed on a last row of the preceding sheet 1-A. When print data on the following sheet 1-B is transmitted from the host computer 214 via the I/F unit 213, the feeding roller 3 is driven and the leading edge of the following sheet 1-B is brought into contact with the conveyance nip portion, thereby performing the skew correction operation on the following sheet 1-B.

After the skew correction operation on the following sheet 1-B ends, the feeding motor 206 stops driving. Further, the driving force to be transmitted to the drive shaft 19 is stopped so that the pickup roller 2 is not rotated.

The overlap continuous feeding operation will be described with reference to the state ST9 in FIG. 3. When the image forming operation on a row that immediately precedes the last row of the preceding sheet 1-A ends, the conveyance roller 5 is rotated by a predetermined amount to align the leading edge of the following sheet 1-B while maintaining the state where the following sheet 1-B overlaps the preceding sheet 1-A. In this case, both the last row of the preceding sheet 1-A and the first row of the following sheet 1-B are conveyed to the position facing the print head 7. When the leading edge of the following sheet 1-B is aligned, the mode of the feeding motor 206 is changed to the low-speed driving mode. Specifically, the pickup roller 2 and the feeding roller 3 are rotated at 7.6 inches/sec.

After the leading edge of the following sheet 1-B is aligned, the image forming operation is performed on the last row of the preceding sheet 1-A and the first row of the following sheet 1-B in one movement by the print head 7 based on print data. Subsequently, when the following sheet 1-B is intermittently conveyed to perform the printing operation, the preceding sheet 1-A is also intermittently conveyed, and then the preceding sheet 1-A is discharged onto the discharge tray 18 by the discharge roller 9.

After that, if there still is print data after the following sheet 1-B is printed, the processing returns to the state ST4 in FIG. 2 to perform the pickup operation of the third print sheet, and the processing up to the state ST9 in FIG. 3 is repeated. With the configuration as described above, the printing speed can be enhanced when the plurality of print sheets 1 is continuously printed.

Figure 6:
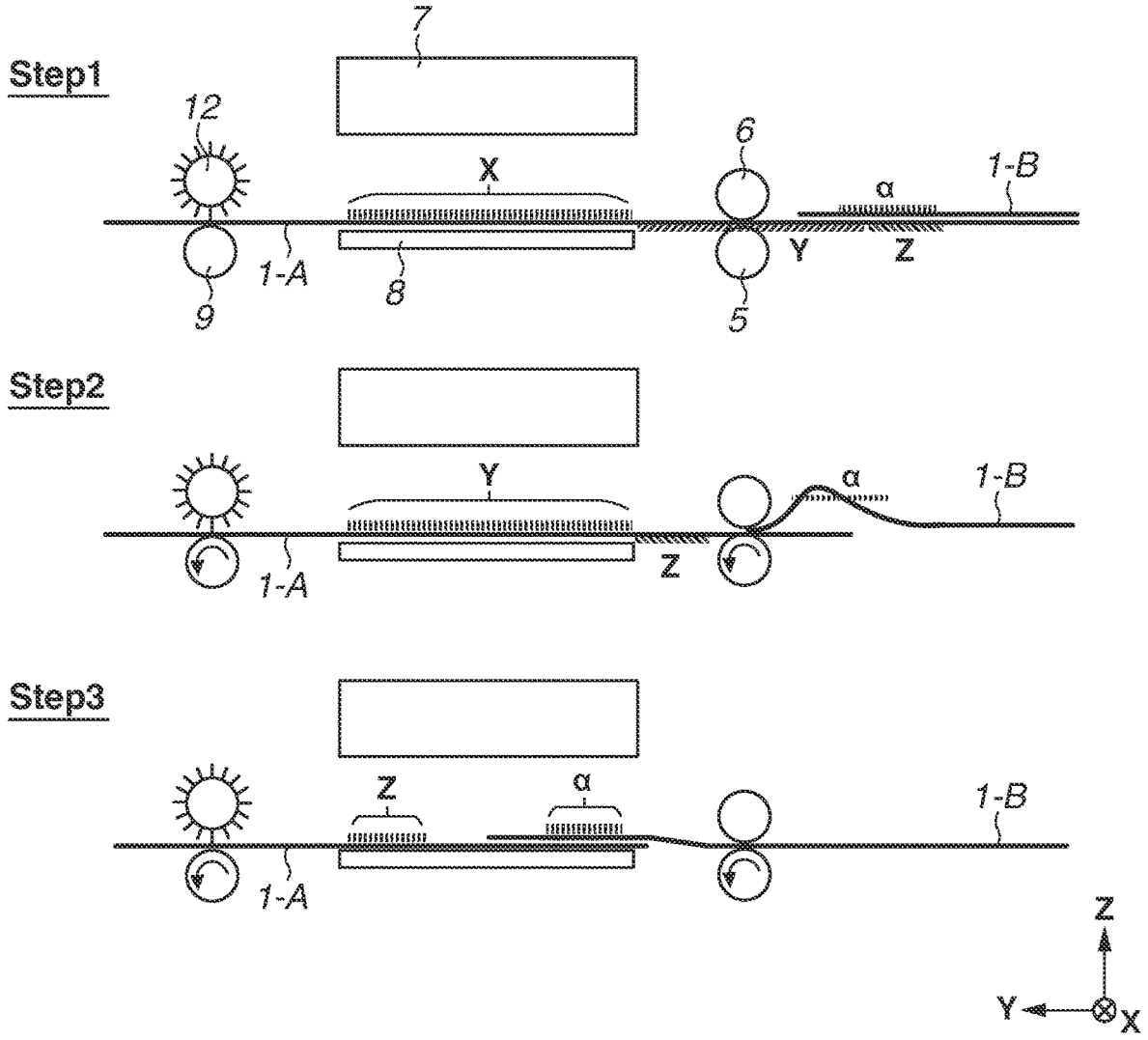
FIG. 6 is a schematic diagram illustrating an operation for printing a sheet in the printing apparatus according to the present exemplary embodiment.

The printing operation according to the present exemplary embodiment will be described in more detail with reference to FIG. 6. FIG. 6 is a schematic diagram illustrating a printing operation to be performed by the printing apparatus 100 according to the present exemplary embodiment, for overlapping a print sheet on another print sheet to form an overlapping portion and printing the preceding sheet and the following sheet in one movement of the print head 7. Like FIG. 1, FIG. 6 is a schematic diagram illustrating an internal state of the printing apparatus 100 and also illustrating an enlarged view of a peripheral area of the print head 7. In the present exemplary embodiment, overlapped print sheets are conveyed, and the print head 7 performs the printing operation on the last row of the preceding sheet 1-A and the first row of the following sheet 1-B in one movement. Step 1 in FIG. 6 illustrates the state ST7 in FIG. 3, and an image area (X) at a row that is two rows before the last row of the preceding sheet 1-A is printed.

Next, step 2 illustrates the state ST8 in FIG. 3, in which an image area (Y) at the row that immediately precedes the last row of the preceding sheet 1-A is printed and the skew correction operation is performed on the following sheet 1-B.

Next, step 3 illustrates the state ST9 in FIG. 3, in which an image area (Z) at the last row of the preceding sheet 1-A and an image area ($\alpha$) at the first row of the following sheet 1-B are printed in one movement by the print head 7.

Figure 7:
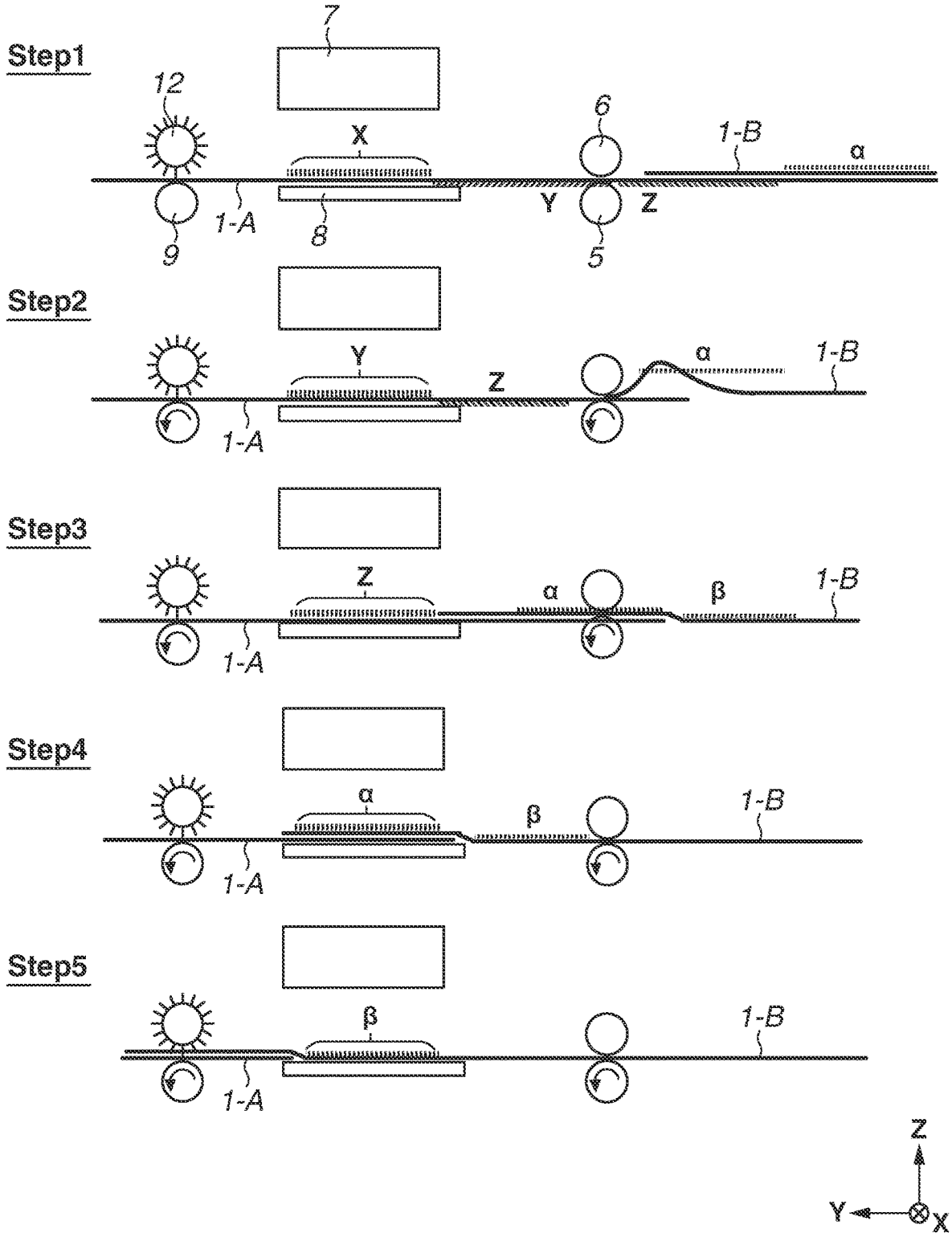
FIG. 7 is a schematic diagram illustrating an operation for printing a sheet in the printing apparatus according to the present exemplary embodiment.

Depending on the position on the print medium on which an image is to be printed, printing of the preceding sheet 1-A may be completed in the previous movement of the print head, and printing of the following sheet 1-B may be performed in the subsequent movement of the print head. FIG. 7 is a schematic diagram illustrating a state where the overlapping portion according to the present exemplary embodiment is formed and the printing operation is performed by the printing apparatus 100 that performs printing on the preceding sheet and the following sheet in different movements of the print head 7, and also illustrating an enlarged view of a peripheral area of the print head 7, like in FIG. 6. FIG. 7 illustrates each step of the operation in the state ST6 in FIG. 2 and subsequent states. Differences between this operation and the operation described above with reference to FIG. 6 will be described with reference to FIG. 7.

In step 1 illustrated in FIG. 7, the row (image area X) that is two rows before the last row is printed at a non-overlapping portion of the preceding sheet which does not overlap the following sheet 1-B. At this time, the leading edge of the following sheet 1-B reaches a position before the conveyance roller pair by a predetermined amount.

Next, in step 2, the row (image area Y) that immediately precedes the last row of the preceding sheet 1-A is printed. At this time, the skew correction operation is performed on the following sheet 1-B. After the skew correction is completed, the leading edge of the following sheet 1-B is aligned and the following sheet 1-B is conveyed together with the preceding sheet 1-A.

In step 3 illustrated in FIG. 7, the image area Z at the last row of the preceding sheet 1-A is printed. In step 3, the length of the image area Z in the Y-direction is substantially equal to the length of the print head 7. Accordingly, the image area Z is printed in one movement of the print head 7 and printing of the preceding sheet 1-A is completed.

In step 4, the subsequent movement of the print head 7 is performed and the image area α is printed at the overlapping portion of the following sheet 1-B in one movement.

Next, in step 5, the printing operation is performed on an image area to be printed at the non-overlapping portion of the following sheet 1-B. In the manner as described above, the non-overlapping portion of the preceding sheet and the overlapping portion of the following sheet may be printed in different movements of the print head 7. If the overlapping portion has a great width, the overlapping portion may be printed in a plurality of movements of the print head 7.

If the printing apparatus 100 can execute two modes, i.e., a one-side printing mode for performing one-side printing, and a double-sided printing mode for performing double-sided printing, the following sheet 1-B may overlap the preceding sheet 1-A when the second surface (back surface) of the preceding sheet 1-A is printed after the first surface (front surface) of the preceding sheet 1-A is printed for double-sided printing. In this case, the second surface (back surface) of the preceding sheet 1-A and the first surface (front surface) of the following sheet 1-B are printed in one movement of the print head 7.

Figure 8:
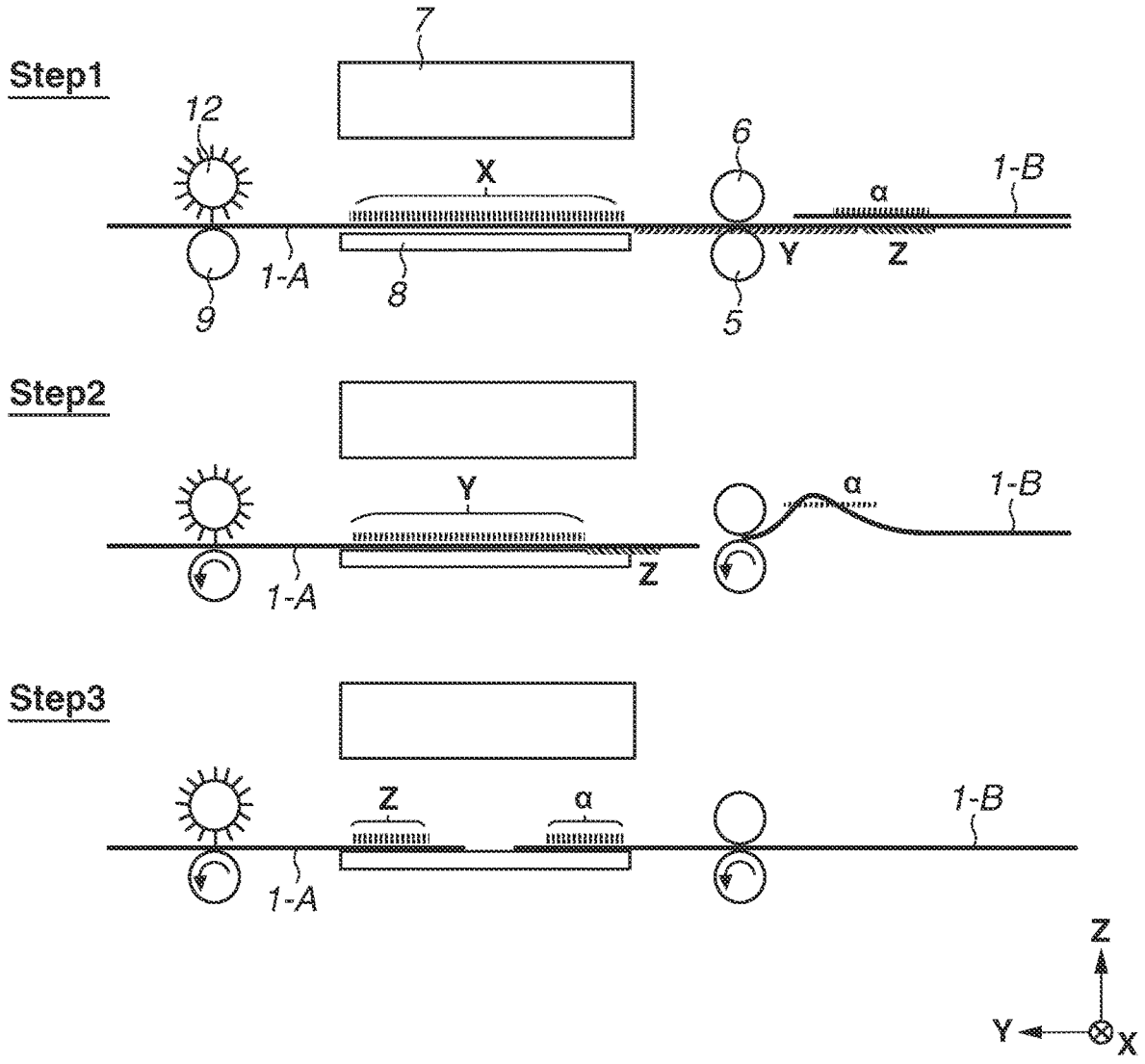
FIG. 8 is a schematic diagram illustrating an operation for printing a sheet in the printing apparatus according to the present exemplary embodiment.

FIG. 8 is a schematic diagram illustrating the printing operation performed by the printing apparatus 100, according to the present exemplary embodiment, which performs printing on the preceding sheet and the following sheet in one movement of the print head 7 without overlapping the printing sheets, and also illustrating an enlarged view of a peripheral area of the print head 7, like in FIG. 6. FIG. 8 illustrates each step of the operation in the state ST6 in FIG. 2 and subsequent states. Differences between this operation and the operation described above with reference to FIG. 6 will be described with reference to FIG. 8. FIG. 8 illustrates the operation for printing the last row (Z) of the preceding sheet 1-A and the first row (α) of the following sheet 1-B in one movement the print head 7 in a state where the preceding sheet 1-A and the following sheet 1-B do not overlap each other.

First, step 1 in FIG. 8 illustrates a state where the row that is two rows before the last row of the preceding sheet 1-A is printed and the following sheet 1-B reaches a position before the conveyance roller pair by a predetermined amount.

Next, in step 2, during printing of the row (image area Y) that immediately precedes the last row of the preceding sheet 1-A, the skew correction is performed on the following sheet 1-B. At this time, because the image area (Z) is located in the vicinity of the trailing edge of the preceding sheet 1-A, the preceding sheet 1-A has passed through the conveyance roller pair when printing is performed on the row that immediately precedes the last row of the preceding sheet 1-A. Accordingly, the preceding sheet 1-A and the following sheet 1-B cannot overlap each other.

Next, in step 3, the preceding sheet 1-A and the following sheet 1-B are conveyed to the position facing the print head 7 to be printed. The last row (image area Z) of the preceding sheet 1-A and the first row of the following sheet 1-B (α) are printed in one movement of the print head 7.

Next, an ink landing position when overlapped sheets are printed as illustrated in FIG. 6 will be described.

Figure 9A:
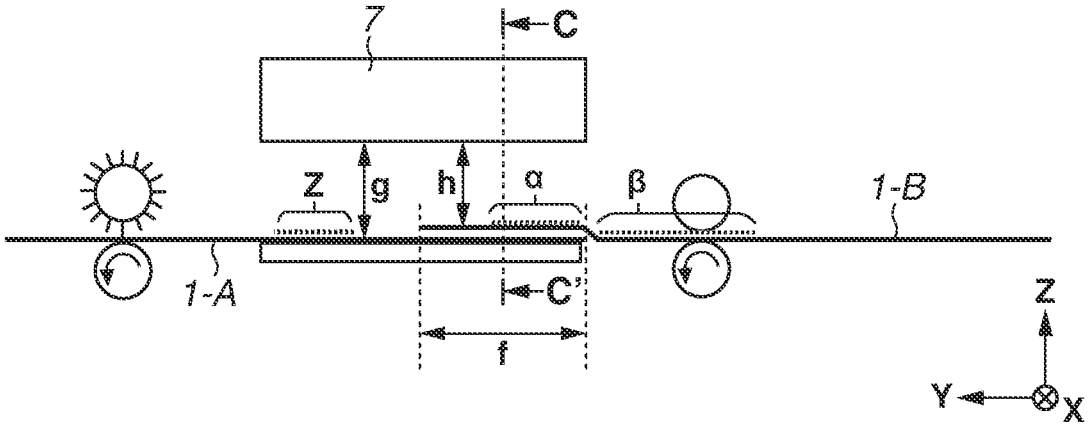
FIGS. 9A and 9B are schematic diagrams each illustrating a landing position of a recording material according to the present exemplary embodiment.
Figure 9B:
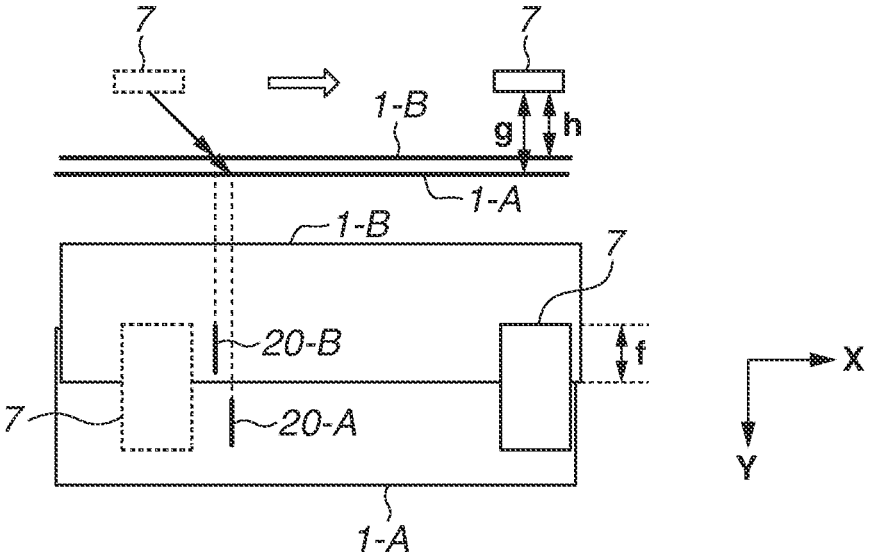

FIGS. 9A and 9B are schematic diagrams each illustrating a printing operation according to a comparative embodiment, and the timing in this printing operation corresponds to the timing in step 3 illustrated in FIG. 6. FIG. 9A illustrates a peripheral area of the print head 7 when viewed from the same position as that in FIG. 6. FIG. 9A also illustrates a state where the image area Z at the last row of the preceding sheet 1-A and the image area α at the first row of the following sheet 1-B are printed in one movement of the print head 7. At this time, a distance g between the front surface of the preceding sheet 1-A and an ejection port surface where the ejection ports of the print head 7 are provided is different from a distance h between the front surface of the following sheet 1-B and the ejection port surface. The difference between the distance g and the distance h corresponds to the thickness of the following sheet 1-B. An upper portion of FIG. 9B is a schematic sectional view illustrating a section when the print head 7 and the media are taken along the direction perpendicular to the Y-axis and taken along a line C-C' in FIG. 9A. A lower portion of FIG. 9B is a schematic diagram illustrating a printing surface of a sheet when the printing apparatus 100 illustrated in FIG. 9A is viewed from above in the Z-direction. FIG. 9B illustrates images of the image areas α and Z illustrated in FIG. 9A as images 20-A and 20-B of one vertical line extending in the Y-direction.

As illustrated in FIG. 9B, the print head 7 ejects ink droplets to the print sheet surface while moving in a direction (X-direction) which is perpendicular to the conveyance direction (+Y-direction) of the print medium and parallel to the print sheet surface. As described above, at the position facing the print head 7, the distance h between the ejection port surface and the following sheet 1-B, the leading edge of which is placed on the trailing edge of the preceding sheet 1-A to form the overlapping portion, is smaller than the distance g, and the portion of the following sheet 1-B that overlaps the preceding sheet 1-A is located closer to the ejection port surface of the print head 7 than the preceding sheet 1-A is. As illustrated in FIG. 9B, when the print head 7 ejects ink from the ejection ports, which are arranged in the Y-direction, while moving in a positive direction (rightward in FIG. 9B) in the X-direction, an ink droplet group is ejected obliquely to the print sheet and lands on the print sheet. At this time, the ink droplet group ejected at the same timing from the print head 7 first lands on the image area α which is formed at an overlapping portion f of print sheets, and then lands on the image area Z formed at the non-overlapping portion, which is a portion other than the overlapping portion f, so that a misalignment occurs in the printing position in a main-moving direction. In the image data, the image 20-A to be printed as the image area α and the image 20-B to be printed as the image area Z are set to be printed at the same position in the X-direction. However, when the image 20-A and the image 20-B are compared, the image 20-B is formed at a position which deviates from the position of the image 20-A in –X-direction, if the image area to be formed subsequently to the image area α on the following sheet 1-B is formed at the non-overlapping portion, the positions of the image area α and the image area β on the print medium deviate front each other.

Ink is ejected in such a manner that the images of the image areas Z and a are to be accurately printed at the same position in the X-direction (main-moving direction) of the image of the image area Z in a state where print sheets do not overlap each other. Accordingly, the image of the image area α to be formed deviates in a direction opposite to the moving direction of the print head 7 due to overlapping of print sheets.

Figure 10A:
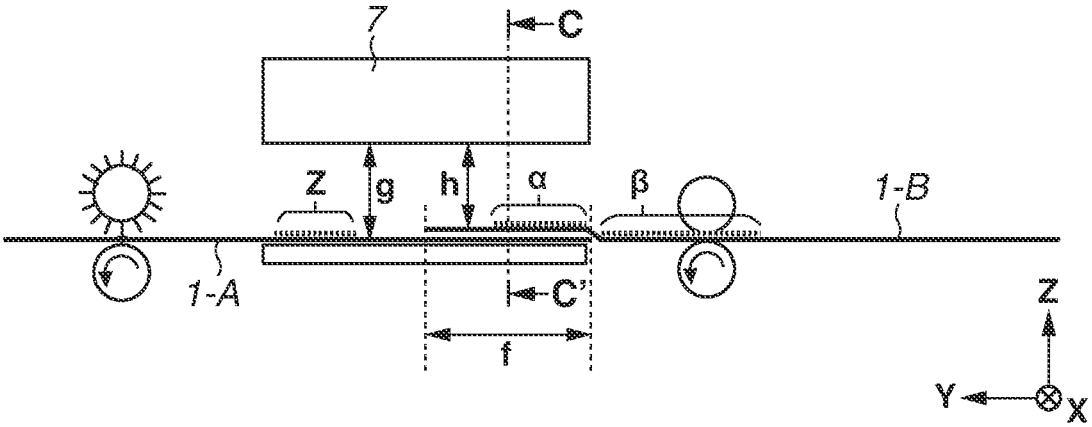
FIGS. 10A and 10B are schematic diagrams each illustrating a control operation for correcting the landing position of the recording material according to the present exemplary embodiment.
Figure 10B:
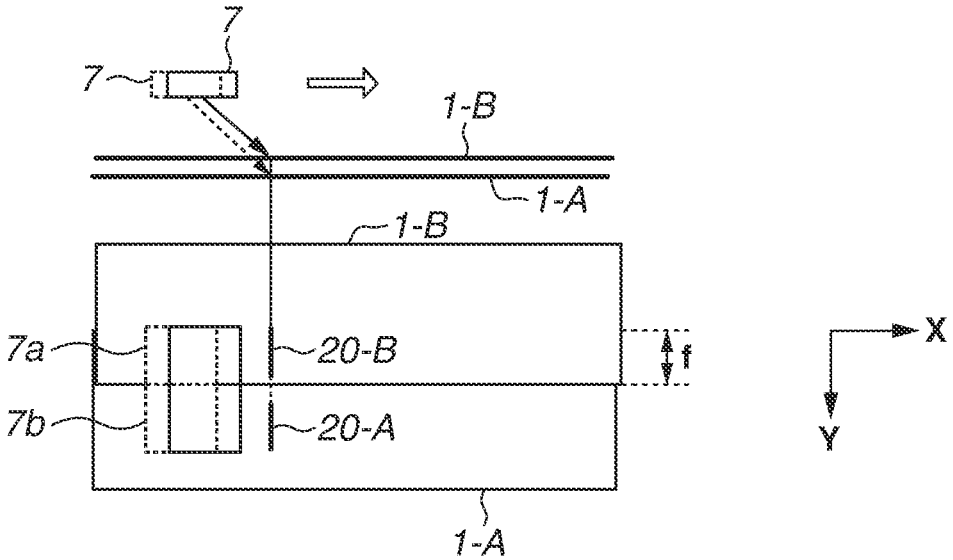

FIGS. 10A and 10B are schematic diagrams illustrating the printing operation according to the present exemplary embodiment, and the timing in this printing operation corresponds to the timing in step 3 illustrated in FIG. 6. FIG. 10A illustrates a peripheral area of the print head 7 when viewed from the same position as that in FIG. 6. FIG. 10A also illustrates a state where the image area Z at the last row of the preceding sheet 1-A and the image area α at the first row of the following sheet 1-B are printed in one movement of the print head 7. An upper portion of FIG. 10B is a schematic sectional view illustrating a section when the print head 7 and the media are taken along the direction perpendicular to the Y-axis and taken along the line C-C' in FIG. 10A. A lower portion of FIG. 10B is a schematic diagram illustrating a printing surface of a sheet when the printing apparatus 100 illustrated in FIG. 10A is viewed from above in the Z-direction. FIG. 10B illustrates images of the image areas α and Z illustrated in FIG. 10A as the images 20-A and 20-B of one vertical line extending in the Y-direction. In the image data, the image 20-A to be printed as the image area α and the image 20-B to be printed as the image area Z are set to be printed at the same position in the X-direction.

As illustrated in FIG. 10A, ink is ejected onto sheets at different timings so as to land on the same positions in the moving direction (X-direction) when the image 20-A is formed on the preceding sheet 1-A and the image 20-B is formed at the overlapping portion of the following sheet 1-B. In the present exemplary embodiment, the timing of ejecting ink to the non-overlapping portion is timing set as a predetermined design value. Based on the timing set as the design value, the timing of ejecting ink onto the overlapping portion is delayed so that the ink lands on the same positions in the main-moving direction of the images to be formed at the non-overlapping portion.

When the printing apparatus 100 is viewed from above as illustrated in FIG. 10B, the ejection ports of the print head 7 are grouped into an ejection port group 7*a* which faces the preceding sheet 1-A and an ejection port group 7*b* which faces the overlapping portion of the following sheet 1-B.

In this case, the ink ejection timing for the ejection port group 7*a* is later than the ink ejection timing for the ejection port group 7*b*. The ejection port group 7*b* ejects ink when the print head 7 is located at a position that is indicated by a dashed line in FIG. 10B, and the image 20-A is formed as the image area Z in an area near the overlapping portion f. Ink is ejected from the ejection port group 7*a* when the print head 7 is located at a position that is indicated by a solid line in FIG. 10B where the print head 7 moves in the X-direction, and the image 20-B is formed as the image area α. As a result, correction is performed in such a manner that the position, in the main-moving direction of the print head 7, of the image of the image area α formed on the sheet that is placed on the other sheet at the overlapping portion matches the position, in the main-moving direction, of the image of the image area α at the non-overlapping portion, so that a misalignment is less likely to be observed.

As described above, as illustrated in FIGS. 10A and 10B, the ink ejection timing is controlled in such a manner that the ink ejection timing for some of the ejection ports of the print head 7 is different from the ink ejection timing for the other ejection ports of the print head 7, thereby making it possible to prevent a misalignment between the image forming position at the overlapping portion of print sheets and the image forming position at the non-overlapping portion. The degree of difference between the ink ejection timings may be set depending on the difference between the distance g and the distance h, and the timing can be determined so that the print head driver 207 generates a drive signal depending on the type of a print medium input by the user through the printer driver 2141.

As illustrated in FIG. 8, when print sheets do not overlap each other, a misalignment between ink landing positions due to overlapping of print sheets does not occur. Accordingly, the ink ejection timing of each nozzle for printing the preceding sheet 1-A and the following sheet 1-B is maintained at a reference timing.

Figure 13:
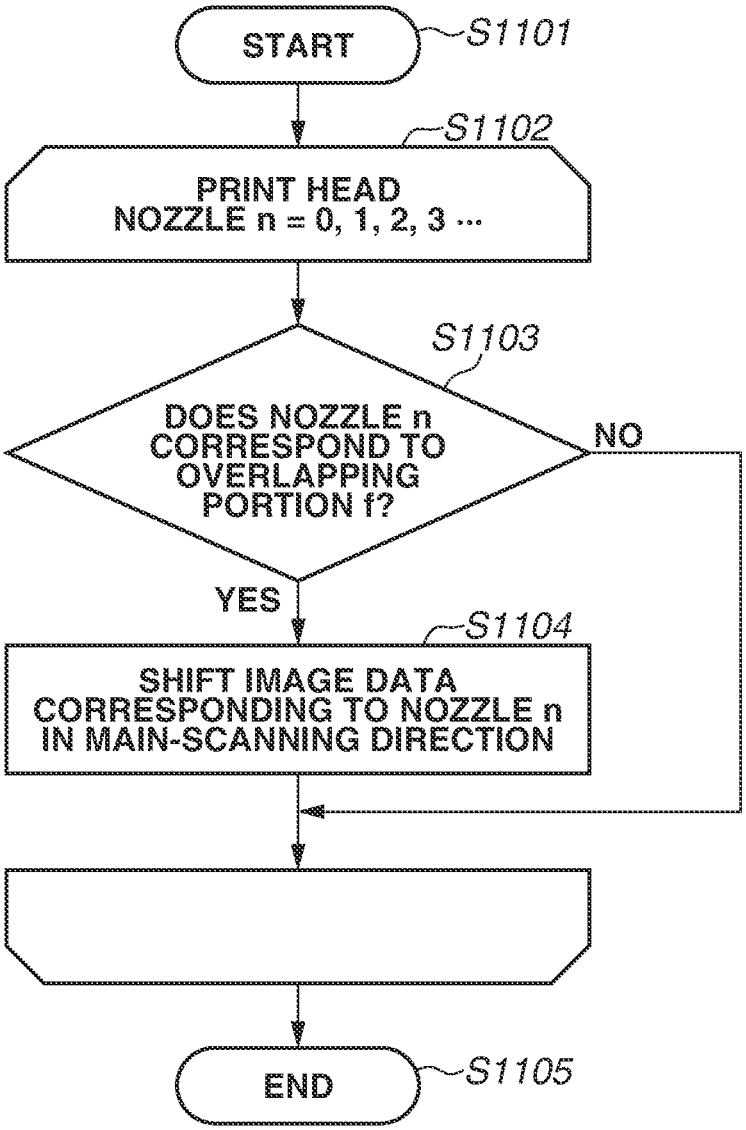
FIG. 13 is a flowchart illustrating a control operation for correcting the landing position of the recording material according to the present exemplary embodiment.

FIG. 13 is a flowchart for correcting a misalignment between landing positions in the present exemplary embodiment. The processing illustrated in FIG. 13 is performed in such a manner that the MPU 201 executes a program stored in the ROM 202. Before the print head 7 moves to perform the printing operation, the processing is started from step S1101.

As illustrated in a loop S1102 in FIG. 13, a determination is made on all nozzles of the print head 7. In step S1103, it is determined whether each nozzle corresponds to the overlapping portion of print sheets.

If the determination result indicates YES in step S1103, the ink ejection timing of a printing nozzle n is delayed. In the present exemplary embodiment, as illustrated in step S1104, the image data corresponding to the printing nozzle n is shifted in the moving direction of the print head 7 so as to delay the ink ejection timing of the print head 7. The processing of step S1104 will be described in more detail below.

As described above, in the present exemplary embodiment, as illustrated in FIG. 13, the ink ejection timing is determined for each nozzle depending on whether the nozzle corresponds to the overlapping portion f of the print sheets, and the ink ejection timing is changed as needed to thereby correct the ink landing position. The determination does not have to be made for each nozzle, but instead the ink ejection timing may be changed, for example, for every eight successive nozzles. In this case, in step S1103, it is determined whether at least one of the eight nozzles corresponds to the overlapping portion. If the determination result indicates YES in step S1103, the processing proceeds to step S1104.

In step S1104, the image data corresponding to the eight nozzles is shifted in the main-moving direction of the print head 7.

A method for adjusting the ink ejection timing by shifting the image data as illustrated in step S1104 of FIG. 13 will be described with reference to FIGS. 14 to 17. The image data secured in the RAM 203 includes the image areas a and Z. The image data is corrected in an intermediate buffer area for head transfer in the MPU 201 under control of the MPU 201.

Figure 14:
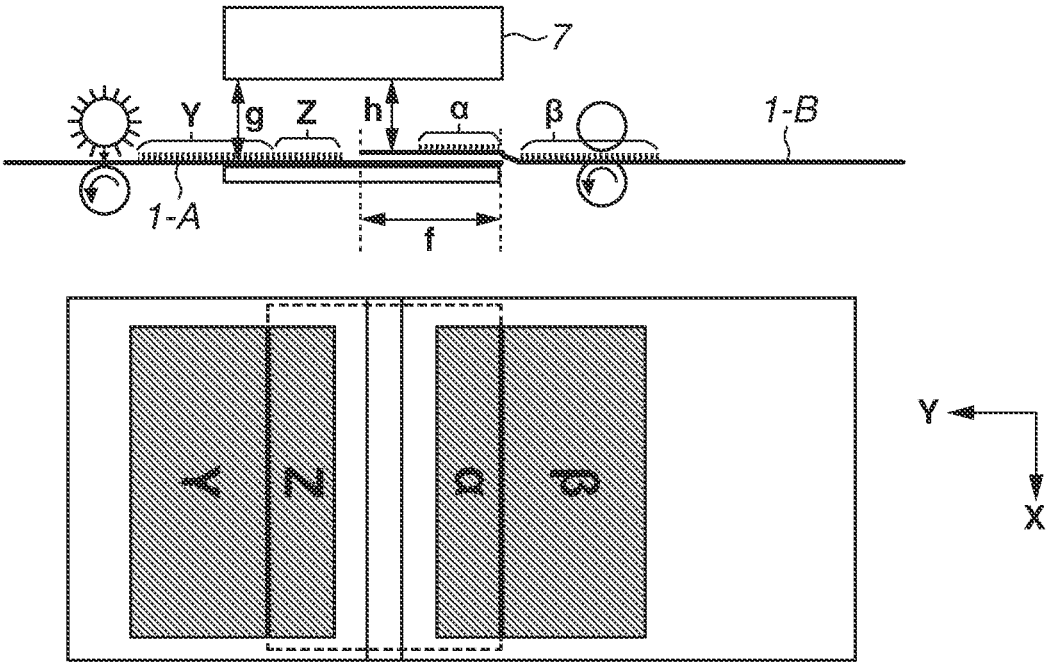
FIG. 14 illustrates states of image data according to the present exemplary embodiment.
Figure 14:
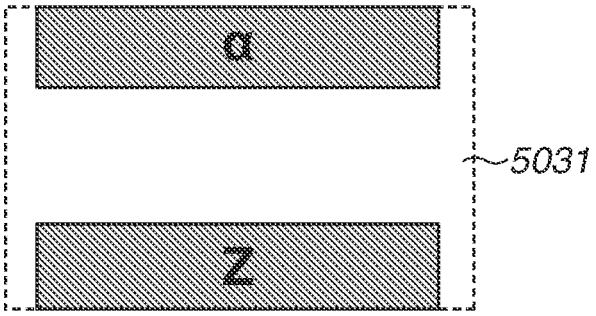
Figure 14:
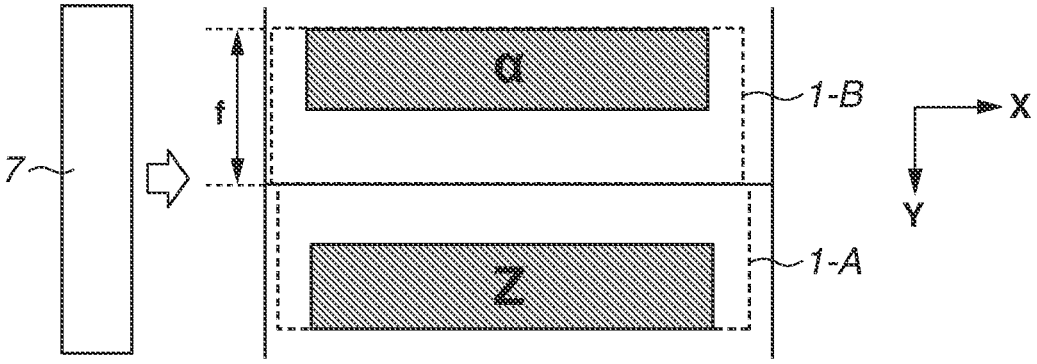

FIG. 14 is a schematic diagram illustrating printing states according to a comparative embodiment. An upper portion (A0) of FIG. 14 corresponds to FIG. 9A. A lower portion of FIG. 14 illustrates a relationship between the sheets 1-A and 1-B and image areas to be formed. In the comparative embodiment, the image data is not corrected. A portion (A1) of FIG. 14 is a conceptual diagram illustrating a state of image data which is mapped in the RAM 203 and is stored in an intermediate buffer 5031 for head transfer. In the case of performing printing using the image data, ink ejected onto the overlapping portion f based on the image data lands earlier due to the thickness of the print sheet 1-B and a misalignment between the images occurs. As a result, a printed image as illustrated in a portion (A2) of FIG. 14 is obtained. The print head 7 moves in the +X-direction (rightward in the portion (A2) of FIG. 14), and thus the image of the image area α corresponding to the overlapping portion f is formed in such a way that the image deviates from an accurate printing position in the −X-direction (leftward in the portion (A2) of FIG. 14).

Figure 15:
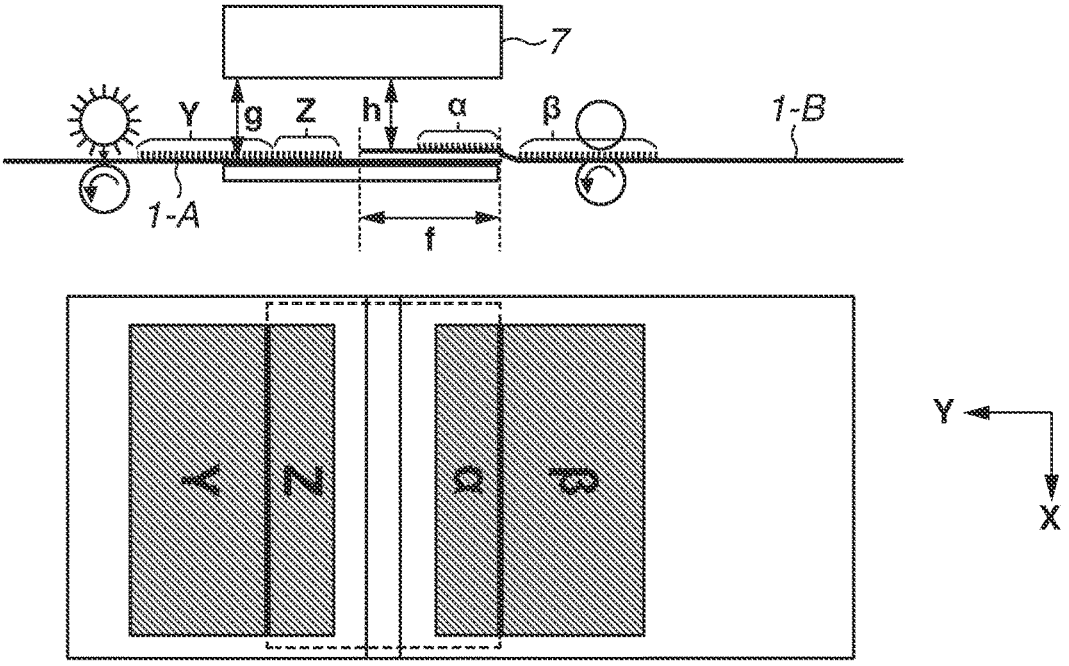
FIG. 15 illustrates states of image data according to the present exemplary embodiment.
Figure 15:
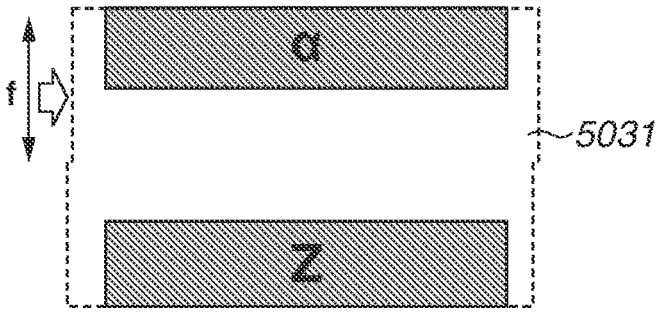
Figure 15:
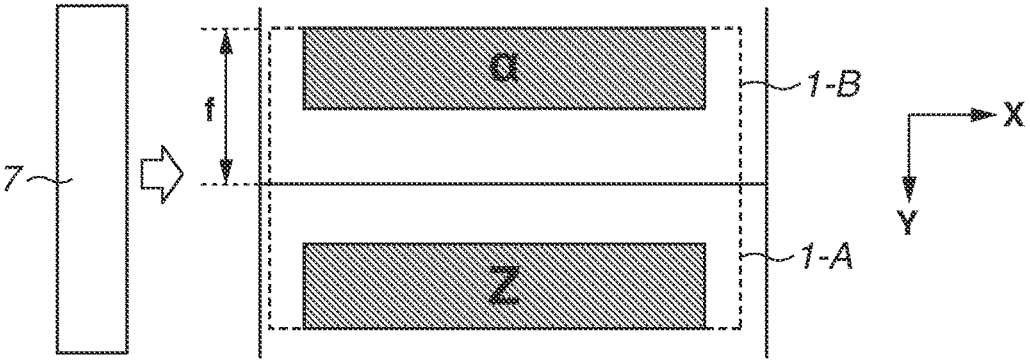

FIG. 15 is a schematic diagram illustrating a state of printing according to the present exemplary embodiment. An upper portion (B0) of FIG. 15 corresponds to FIG. 10A. A lower portion of FIG. 15 illustrates a relationship between the sheets 1-A and 1-B and image areas to be formed. A portion (B1) of FIG. 15 is a conceptual diagram illustrating a state of image data which is mapped in the RAM 203 and is stored in the intermediate buffer 5031 for head transfer. The portion (B1) of FIG. 15 illustrates the result of carrying out step S1104 illustrated in FIG. 13 on the image data. As illustrated in the portion (B1) of FIG. 15, the storage position of the image data is shifted in the +X-direction (rightward in the portion (B1) of FIG. 15) on the intermediate buffer 5031 for head transfer so as to change the printing position of each pixel constituting the image corresponding to the overlapping portion f. In this manner, the pixel position of each pixel corresponding to the overlapping portion f in the image data is changed. By using the corrected image data, the printing result with a small misalignment can be obtained on the print sheet 1-B as illustrated in a portion (B2) of FIG. 15. Further, the timing of reading out the image corresponding to the overlapping portion f from the intermediate buffer 5031 for head transfer may be shifted from the timing of reading out the image corresponding to the non-overlapping portion, to thereby change the printing position of the image corresponding to the overlapping portion f.

Figure 16:
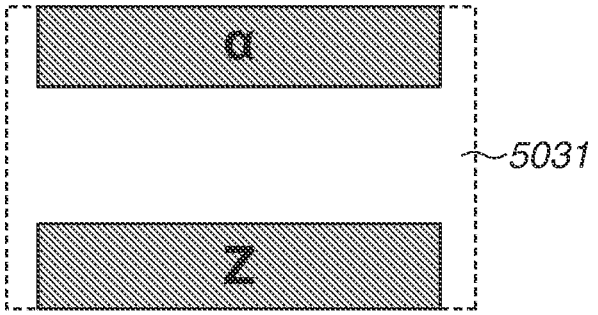
FIG. 16 illustrates states of image data according to the present exemplary embodiment.
Figure 16:
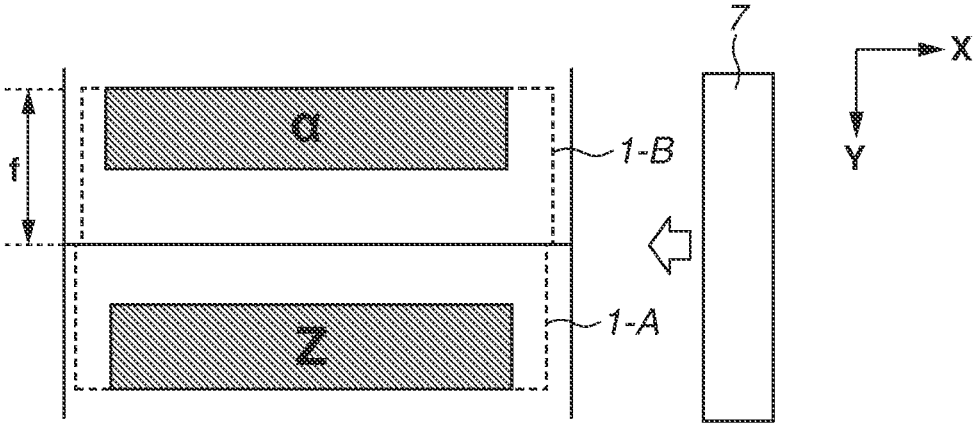
Figure 17:
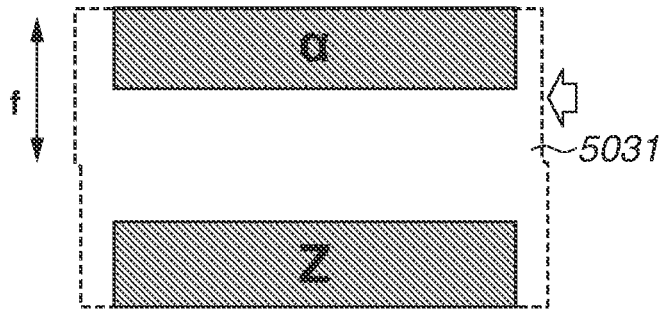
FIG. 17 illustrates states of image data according to the present exemplary embodiment.
Figure 17:
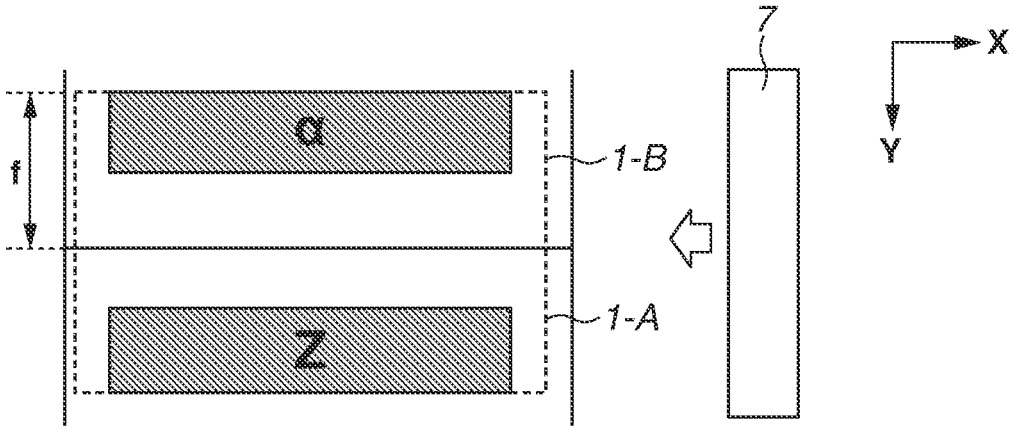

FIG. 16 is a schematic diagram illustrating a state where printing is performed on the overlapping portion f in the same manner as in the comparative embodiment illustrated in FIG. 14. FIG. 17 is a schematic diagram illustrating a state where printing is performed on the overlapping portion f in the same manner as in the exemplary embodiment illustrated in FIG. 15. However, FIGS. 15 and 17 each illustrate a case where the moving direction of the print head 7 is the −X-direction which is opposite to that illustrated in FIGS. 14 and 16. Referring to FIG. 16, when printing is performed based on image data that is not corrected as illustrated in a portion (A1) of FIG. 16, a printed image as illustrated in a portion (A2) of FIG. 16 is obtained. The image area α corresponding to the overlapping portion f is formed at a position that deviates from the accurate printing position in the +X-direction (rightward in the portion (A2) of FIG. 16).

Accordingly, as illustrated in a portion (B1) of FIG. 17, the data corresponding to the overlapping portion f is shifted leftward in advance on the intermediate buffer 5031 for head transfer. As a result, the printing result with a small misalignment as illustrated in a portion (B2) of FIG. 17 can be obtained on the print sheet 1-B.

The data holding method illustrated in FIGS. 15 and 17 is an example. Even if the intermediate buffer 5031 for head transfer illustrated in FIG. 15 is not provided, the method of shifting data to be allocated to each nozzle for ejecting ink onto the overlapping portion of print sheets can be implemented.

Figure 18:
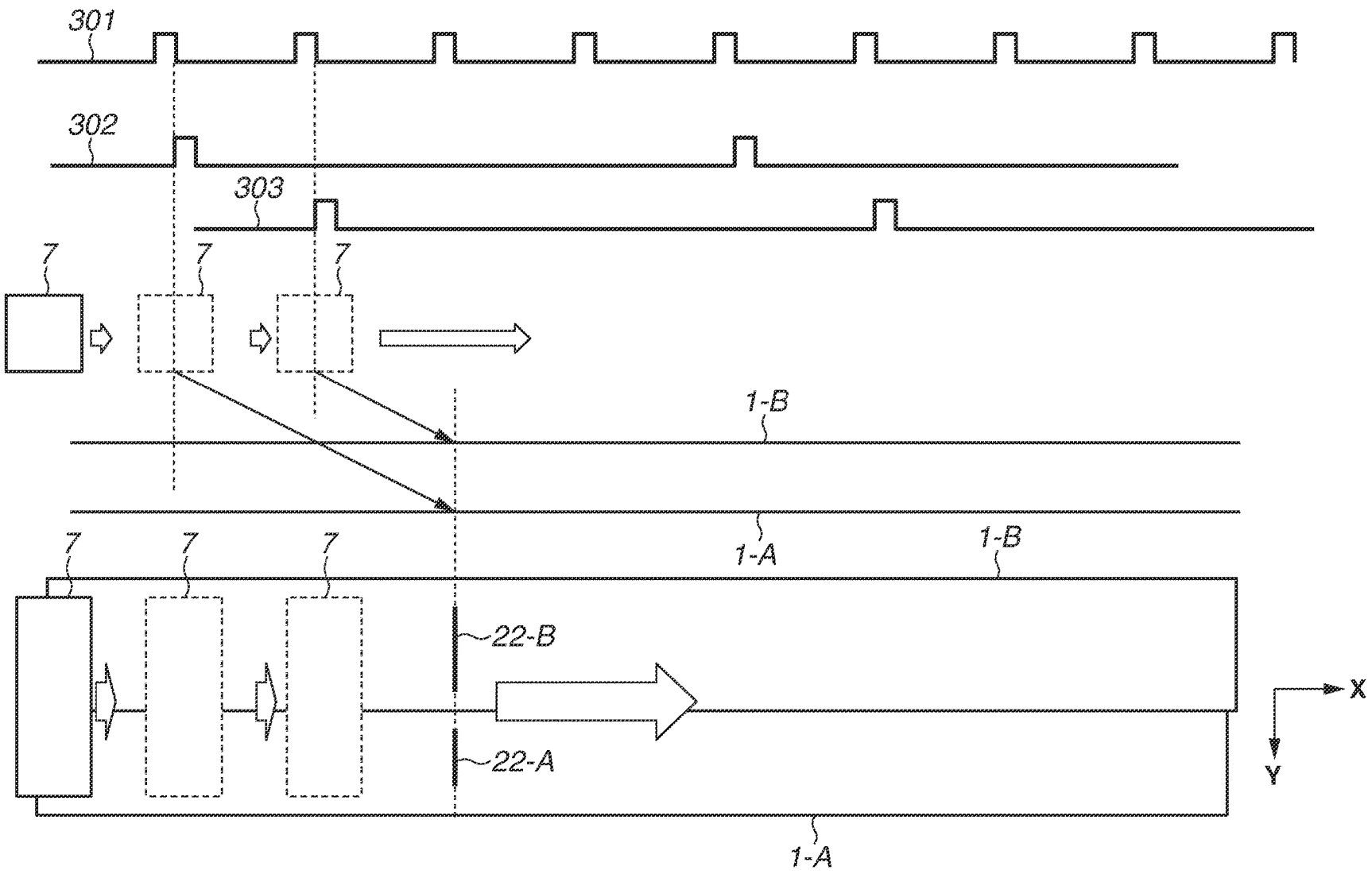
FIG. 18 illustrates a control operation for correcting the landing position of the recording material according to the present exemplary embodiment.

A method for controlling the timing of ejecting ink from the ejection ports of the print head 7 by a method different from that illustrated in FIG. 13 will be described with reference to FIG. 18. FIG. 18 illustrates an operation for controlling the timing by changing the drive signal for the print head 7 by the MPU 201 according to embodiments of the present invention. A latch trigger signal 301 rises depending on the amount of movement of the carriage 10 in the main-moving direction of the print head 7. A heat trigger signal 302 is generated by sampling the latch trigger signal 301 at regular intervals, and generates timing of ejecting ink from the print head 7. In this example, the heat trigger signal 302 is a reference signal. An adjustment heat trigger signal 303 is generated by sampling the latch trigger signal 301 at intervals different from those of the heat trigger signal 302.

Referring to FIG. 18, the nozzle group facing the preceding sheet 1-A in the print head 7 ejects ink at the timing indicated by the heat trigger signal 302, and an image 21-A is formed on the surface of a print sheet. On the other hand, the nozzle group facing the following sheet 1-B ejects ink at the timing indicated by the adjustment heat trigger signal 303, and an image 21-B is formed on the surface of a print sheet.

Thus, according to the example illustrated in FIG. 18, the interval between the heat trigger signal 302 and the adjustment heat trigger signal 303 can be set more finely than the resolution of the image data. Consequently, a misalignment between the ink landing position on the preceding sheet 1-A and the ink landing position on the following sheet 1-B can be adjusted more finely than the resolution of the image data.

FIG. 18 is merely an example. Regardless of the trigger generation method, the ink ejection timing can be shifted as long as the trigger signal to be allocated to each nozzle facing the overlapping portion of sheets in the print head 7 can be shifted.

FIGS. 19A to 19C each illustrate an example of the method of holding a correction value. FIGS. 19A and 19B are sectional views of the printing apparatus 100 as viewed from the front side thereof, and schematically illustrate the print head 7 and print sheets. The correction value is stored in the ROM 202, and the type of each print sheet may be preliminarily set, or may be set by the user. FIG. 19A illustrates a misalignment between landing positions when the print sheets 1-A and 1-B have a large thickness, and FIG. 19B illustrates a misalignment between landing positions when the print sheets 1-A and 1-B have a small thickness.

As illustrated in FIGS. 19A to 19C, a misalignment amount x varies depending on the thickness of each print sheet. Accordingly, the correction value is held for each print sheet as illustrated in FIG. 19C so that the degree of correction to be carried out in step S1104 illustrated in FIG.

13 can be changed depending on the type of the set print sheet. When printing is performed, the user inputs the type of each print sheet used for the host computer 214. The input type of each print sheet is sent to the MPU 201 via the I/F unit 213 by the printer driver 2141. The correction is performed by reading out the correction value from the ROM 202 based on information acquired from the MPU 201.

FIGS. 19A to 19C are merely an example. If the thickness of the print sheet is smaller than a predetermined thickness, the misalignment amount x is small and thus there is no need to perform the correction. In this case, a correction table may be set without changing the timing. The misalignment amount x varies not only depending on the thickness of each print sheet, but also depending on, for example, a moving speed of the print head 7. A correction value table for determining the correction value depending on the moving speed of the print head 7 may be used, or a correction value table for determining the correction value based on a combination of the moving speed of the print head 7 and the thickness of each print sheet may be used.

In the first exemplary embodiment, the case where the leading edge of the following sheet 1-B is placed on the trailing edge of the preceding sheet 1-A has been described with reference to FIGS. 9A and 9B and FIGS. 10A and 10B. A second exemplary embodiment illustrates a mode in which the trailing edge of the preceding sheet 1-A is placed on the leading edge of the following sheet 1-B as illustrated in FIGS. 11A and 11B and FIGS. 12A and 12B.

In this state, the distance between the print head 7 and the portion of the image area Z, which is placed on the following sheet 1-B located under the overlapping portion and is formed at the overlapping portion of the preceding sheet 1-A located above the overlapping portion, is smaller than the distance between the print head 7 and the other portion.

Figure 11A:
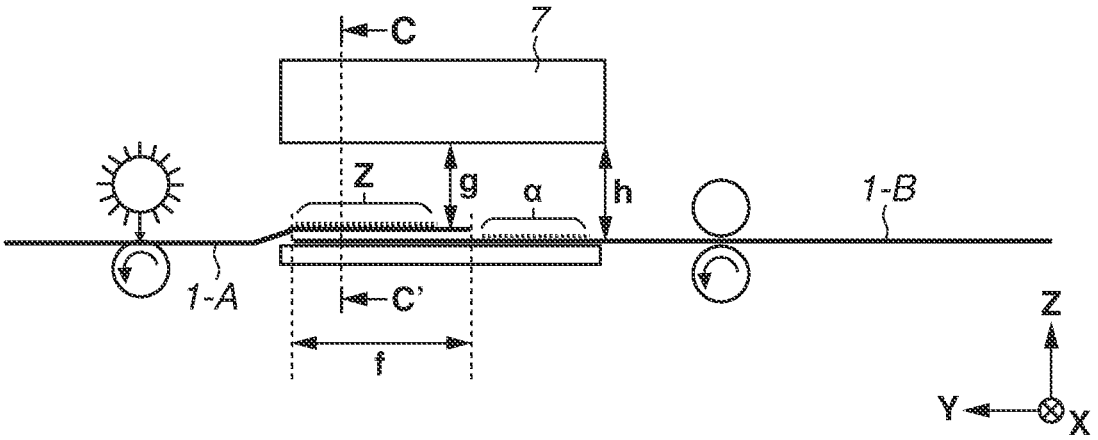
FIGS. 11A and 11B each illustrate the landing position of the recording material according to the present exemplary embodiment.
Figure 11B:
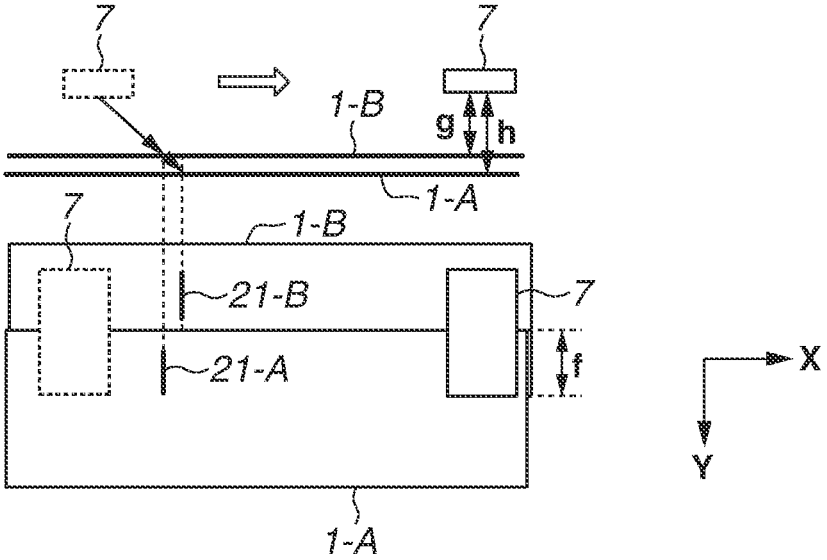

FIG. 11B schematically illustrates the print head 7 and print sheets which are taken along the direction perpendicular to the Y-axis and taken along the line C-C' in FIG. 11A as viewed from the front side (print sheet conveyance direction) of the printing apparatus 100. A lower portion of FIG. 11B illustrates the sheets and printed images as viewed from the top of the printing apparatus 100 according to a comparative embodiment. Assume that images of the image areas n and Z are the images 21-A and 21-B of one vertical line extending in the Y-direction at the same position in the X-direction. When the print head 7 ejects ink while moving horizontally rightward (in a direction indicated by an arrow in FIG. 11B), the ink droplet group is ejected obliquely in the moving direction and lands on the print sheets. At this time, the landing position in the main-moving direction of the ink droplet group ejected at the same timing from the print head 7 in the image area Z in which ink lands on the overlapping portion of the print sheets deviates from that in the image area Z formed in a portion other than the overlapping portion. This misalignment is caused due to the difference in the distance between the print head 7 and the print sheet surface as described above.

Figure 12A:
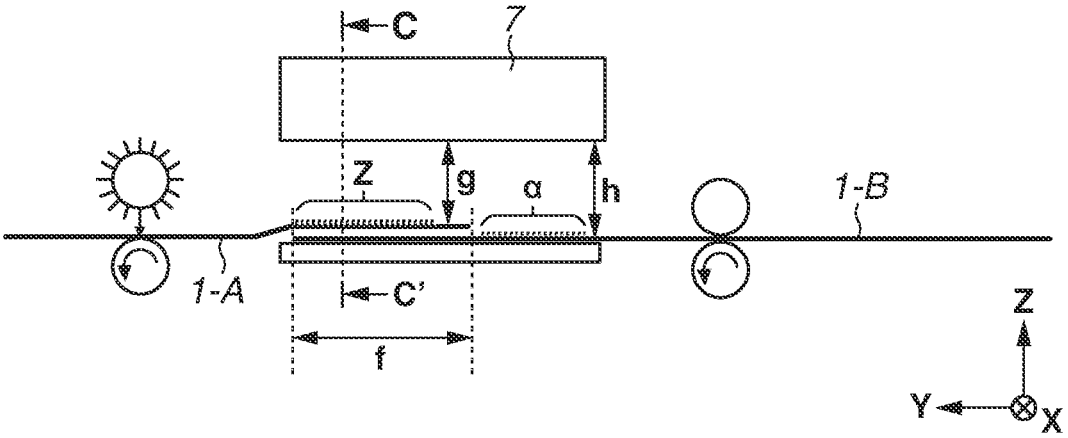
FIGS. 12A and 12B each illustrates a control operation for correcting the landing position of the recording material according to the present exemplary embodiment.
Figure 12B:
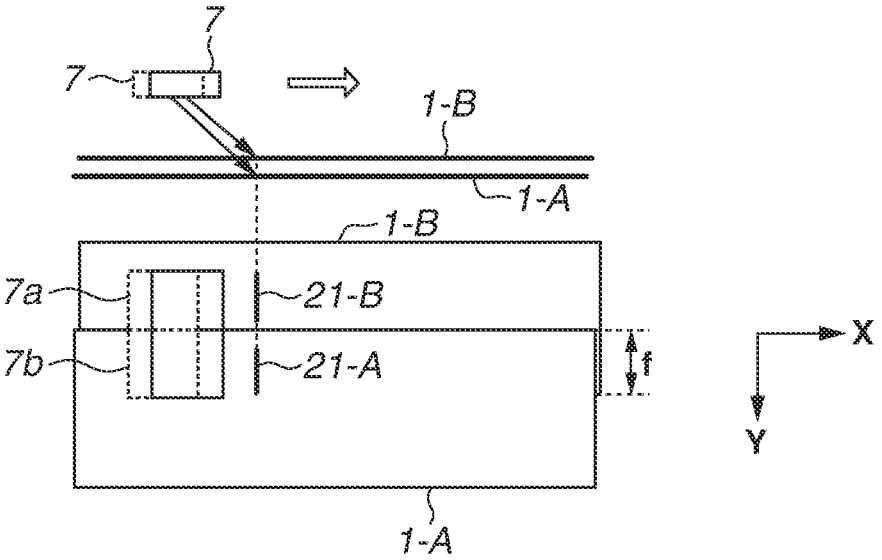

FIG. 12B illustrates a sectional view of the printing apparatus 100 as viewed from the front side thereof and a sectional view of the printing apparatus 100 as viewed from the top when the landing position at the overlapping portion f is corrected. The sectional view of the printing apparatus 100 as viewed from the front side thereof illustrates that ink is ejected at different timings on the preceding sheet 1-A and the following sheet 1-B, respectively, to align the landing positions.

In the top view of the printing apparatus 100 illustrated in FIG. 12B, the ejection port group of the print head 7 is divided into the ejection port group 7*a* that faces the overlapping portion of the preceding sheet 1-A and the following sheet 1-B, and the ejection port group 7*b* other than the ejection port group 7*a*.

At this time, the ink droplet ejection timing for the ejection port group 7*b* is later than that for the ejection port group 7*a* other than the ejection port group 7*b*. When the print head 7 is located at a position that is indicated by a dashed line in FIG. 12B, the ejection port group 7*a* ejects ink to form the image 20-B of the image area α. Thus, the ejection port group 7*b* ejects ink when the print head 7 is located at a position that is indicated by a solid line in FIG. 12B where the print head 7 moves in the X-direction, and the image 1-A of the image area Z is formed. As a result, the position in the main-moving direction of the image of the image area Z formed in a state where print sheets overlap each other is corrected so as to substantially match the position in the main-moving direction of the image of the image area Z formed in a state where print sheets do not overlap each other, so that a misalignment is less likely to be observed.

As illustrated in FIGS. 12A and 12B, the ink ejection timing for some of the nozzles of the print head 7 is controlled to thereby make it possible to correct the landing position on the overlapping portion of the print sheets.

In the first and second exemplary embodiments, the mode in which the timing of ejecting ink from the ejection ports used for printing the overlapping portion of the print sheets is changed has been described. A third exemplary embodiment illustrates a mode in which the landing position is corrected by changing the timing of ejecting ink from the ejection ports for printing the non-overlapping portion.

The present exemplary embodiment illustrates a mode in which the trailing edge of the preceding sheet 1-A and the leading edge of the following sheet 1-B overlap each other. In the mode illustrated in FIG. 9B, a misalignment occurs due to the fact that ink for forming the image area α on the following sheet 1-B is ejected earlier. In the present exemplary embodiment, the timing of ejecting ink for printing an area other than the image area α on the following sheet 1-B is set to earlier timing. Specifically, the timing of ejecting ink onto the non-overlapping portion is set to timing earlier than reference timing when ink lands on the overlapping portion f. As a result, the position of the image area α in the main-moving direction matches the position of the image on the following sheet 1-B in the main-moving direction, so that a misalignment is less likely to be observed.

Further, when there is another following sheet (referred to as another following sheet), the overlapping portion of the other following sheet is placed on the following sheet 1-B which is located at a position that precedes the other following sheet. The timing of ejecting ink onto the overlapping portion of the other following sheet is preferably the same as the timing of ejecting ink onto the overlapping portion of the following sheet 1-B which is located at a position that precedes the other following sheet. In the present exemplary embodiment, the timing of ejecting ink onto the overlapping portion of the print sheets is preferably the same as the timing of ejecting ink when the image area α is formed. This prevents the image formed on each print sheet from being formed on one side of the print sheet as the sheets are continuously fed.

The exemplary embodiments described above illustrate the serial-type printing apparatus that performs printing while the print head 7 moves over print sheets in the X-direction. A printing apparatus according to a fourth exemplary embodiment is a full-line type printing apparatus in which the array of printing ejection ports of the print head has a length corresponding to the width of a print sheet. In this full-line type printing apparatus (hereinafter referred to as a full-line printer), each print sheet is conveyed in the direction (X-direction in this case) which is substantially orthogonal to the fixed array direction of ejection ports of the print head, and thus the print head and the print sheet move relatively to each other to perform printing.

Figure 20A:
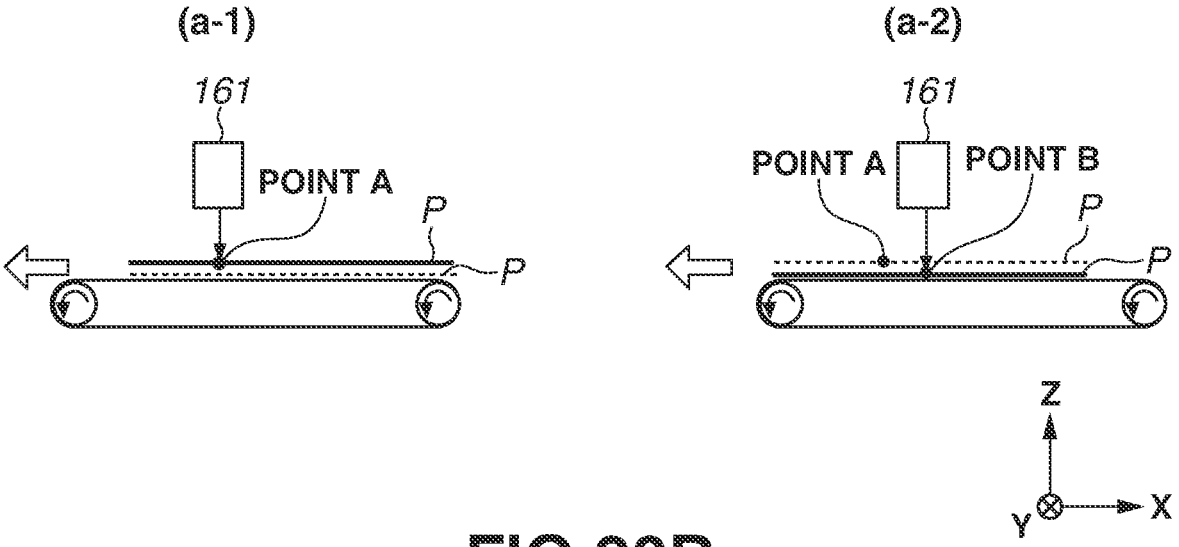
FIGS. 20A to 20C each illustrate a control operation for correcting a landing position of a recording material in a full-line type printing apparatus according to the present exemplary embodiment.
Figure 20B:
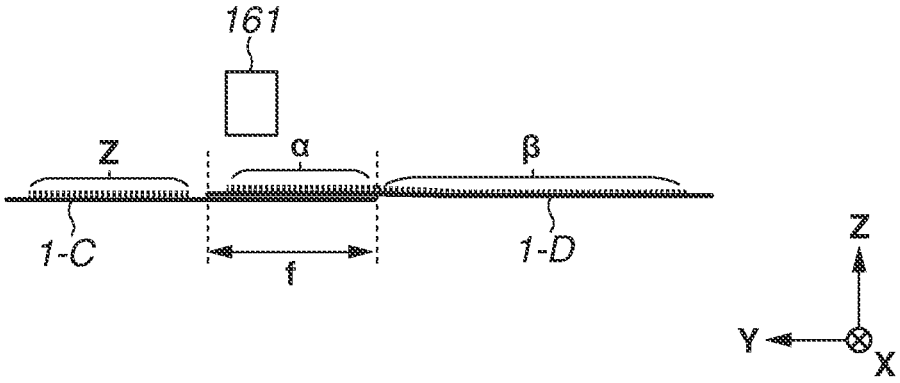
Figure 20C:
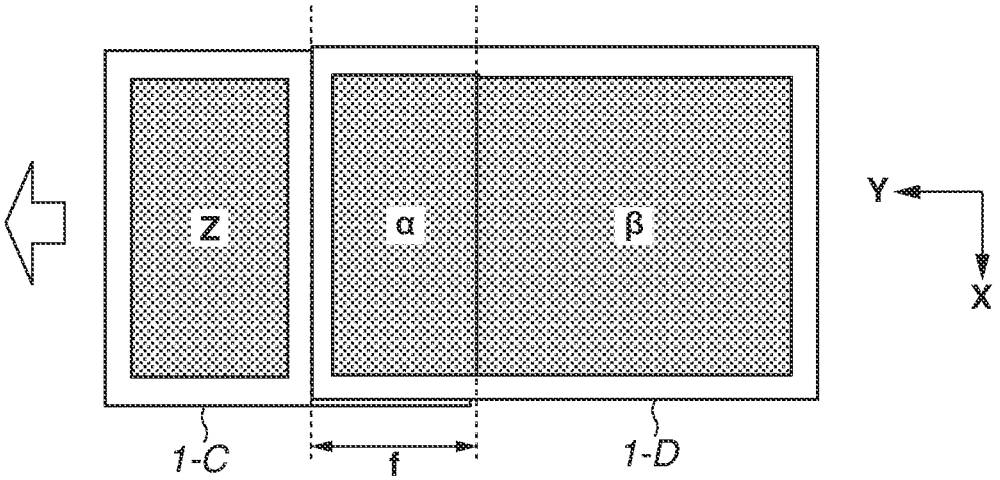

FIGS. 20A to 20C are schematic diagrams each illustrating a printing operation in the fill-line type printing apparatus. A print head 161 is a full-line head disposed in such a manner that the conveyance direction of the print sheet and the printing ejection port array are orthogonal to each other. When the print sheet passes under a lower portion of the print head 161, ink is ejected from the print head 161 to form an image.

A portion (a-1) of FIG. 20A illustrates a state where ink ejected from the print head 161 lands on the overlapping portion of a print sheet P that is placed on another print sheet. The ink landing position is set as a point A. A portion (a-2) of FIG. 20A illustrates a state where ink lands on the non-overlapping portion of the print sheet when ink is ejected at the same time as that illustrated in the portion (a-1) of FIG. 20A. The ink landing position is set as a point B. A time when ink lands on the point B is later than a time when ink lands on the point B, and thus the landing positions in the X-direction are different. This causes a misalignment between the printing positions in the conveyance direction of the print medium at the overlapping portion and the non-overlapping portion in the full-line printer.

FIG. 20B is a schematic diagram illustrating an example of a printing state according to the fourth exemplary embodiment, and also illustrating a case where a peripheral area of the print head 161 is viewed from the same position as that in FIG. 6. FIG. 20C is a schematic diagram illustrating a case where print sheets are viewed from above in the Z-direction.

When two print sheets 1-C and 1-D are continuously printed, the distance from the ejection port surface of the print head 161 to the print sheet at the portion corresponding to the overlapping portion f of the following sheet 1-D is smaller than that at the non-overlapping portion due to the thickness of the print sheet. On the other hand, when ink is ejected onto the overlapping portion f, the printing position is corrected by delaying the timing of ejecting ink from the ejection ports. After ink is ejected at a predetermined ejection cycle fr and the ejection of ink to the non-overlapping portion for forming the image area Z is finished, the ejection of ink to the overlapping portion fat an interval greater than the ejection cycle is started and then ink is ejected at the predetermined ejection cycle fr to form the image area α. After the ejection of ink to form the image area α, ejection of ink for forming the image area β on the non-overlapping portion is started at an interval smaller than the predetermined ejection cycle fr. This correction prevents a misalignment of the printing positions from being observed. The ink ejection timing may be set in such a manner that the print head driver 207 generates a drive signal, like in the first exemplary embodiment, based on, for example, a signal from an encoder that detects the rotation of a motor for conveying a print medium.

As described above, the ink ejection timing is changed with respect to the portion in which a print sheet is placed on another print sheet, thereby making it possible to correct a misalignment between the landing positions due to overlapping of print sheets. According to exemplary embodiments of the present invention, the throughput can be enhanced and a deterioration in image quality can be suppressed even when printing is performed while the state in which print sheets overlap each other is maintained.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiments) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™) a flash memory device, a memory card, and the like.

According to embodiments of the present invention, the timing to eject ink onto the overlapping portion of the sheets is different from the timing to eject ink onto the non-overlapping portion, based on the relative movement of the print head and the print sheet, so that recording can be performed with a high throughput and an excellent recorded image can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-087526, filed Apr. 27, 2018, which is hereby incorporated by reference herein in its entirety.

What is claimed is:

1. A printing apparatus comprising:

a printing unit including an ejection port surface provided with a plurality of ejection ports for ejecting ink arrayed in a predetermined direction and configured to print an image on a sheet by ejecting ink while moving over the sheet in a movement direction intersecting with the predetermined direction;

a conveyance unit configured to convey a sheet in a direction intersecting with the movement direction and to convey a preceding sheet and a following sheet in such a manner that an overlapping portion where a trailing edge of the preceding sheet and a leading edge of the following sheet overlap each other is formed at a printing position facing the ejection port surface of the printing unit; and a control unit configured to control the printing unit such that in a case where the control unit causes the printing unit to print, in a same movement in the movement direction, the overlapping portion of a sheet located closer to the ejection port surface and a non-overlapping portion of one of the preceding sheet and the following sheet where the preceding sheet and the following sheet do not overlap each other, the control unit causes the printing unit to delay ink ejection timing according to the movement of the printing unit with respect to a part of the plurality of ejection ports for printing the overlapping portion from ink ejection timing according to the movement of the printing unit with respect to another part of the plurality of ejection ports for printing the non-overlapping portion of the sheet.

2. The printing apparatus according to claim 1, wherein the conveyance unit changes a length of the overlapping portion formed in a conveyance direction based on image data on one of the preceding sheet and the following sheet, and the printing unit changes ink ejection timing at a position corresponding to the length.

3. The printing apparatus according to claim 1, further comprising:

an acquisition unit configured to acquire information about a type of each of the preceding sheet and the following sheet; and a determination unit configured to determine, based on the information acquired by the acquisition unit, a degree of delaying ink ejection timing according to the movement of the printing unit when the printing unit prints the overlapping portion from ink ejection timing according to the movement of the printing unit when the printing unit prints the non-overlapping portion.

4. The printing apparatus according to claim 3, wherein in a case where a thickness of the preceding sheet and the following sheet is greater than or equal to a predetermined thickness, the printing unit delays, based the information acquired by the acquisition unit, the ink ejection timing according to the movement of the printing unit when the printing unit prints the overlapping portion from the ink ejection timing according to the movement of the printing unit when the printing unit prints the non-overlapping portion, and in a case where the thickness of the preceding sheet and the following sheet is smaller than the predetermined thickness, the printing unit maintains the ink ejection timing to match the ink ejection timing according to the movement of the printing unit when the printing unit prints the overlapping portion with the ink ejection timing according to the movement of the printing unit when the printing unit prints the non-overlapping portion.

5. The printing apparatus according to claim 1, wherein the printing unit corrects timing of ejecting ink onto the overlapping portion to be later than reference timing of ejecting ink onto the non-overlapping portion.

6. The printing apparatus according to claim 5, wherein the printing unit sets, as the reference timing, ink ejection timing according to the movement of the printing unit when the printing unit prints an image on an area near the overlapping portion of one of the sheets forming the overlapping portion located farther from the ejection port surface than the other one of the sheets.

7. The printing apparatus according to claim 1, wherein ink ejection timing according to the movement of the printing unit onto the overlapping portion of the preceding sheet and the following sheet matches ink ejection timing according to the movement of the printing unit onto the overlapping portion of the following sheet and another sheet subsequent to the following sheet.

8. The printing apparatus according to claim 1, further comprising:

a storage unit configured to store image data for printing an image on the sheets, wherein in a case where the image data is stored in the storage unit, the ink ejection timing is controlled by changing a storage position of the image data in the storage unit.

9. The printing apparatus according to claim 1, further comprising:

a control unit configured to control the ink ejection timing by a drive signal for driving a printing element configured to generate energy for ejecting ink, the printing element being included in the printing unit, wherein a method of applying the drive signal to the printing unit when an image is printed on the overlapping portion is different from a method of applying the drive signal to the printing unit when an image is printed on the non-overlapping portion.

10. The printing apparatus according to claim 1, wherein the printing unit prints, in a same movement, the overlapping portion of a sheet with the overlapping portion being closer to the printing unit and the non-overlapping portion of the sheet, and sets timing of ejecting ink when the printing unit starts printing the overlapping portion to be different from timing of ejecting ink when the printing unit starts printing the non-overlapping portion.

11. The printing apparatus according to claim 1, wherein the printing unit prints, in a same movement, the overlapping portion of a sheet with the overlapping portion being closer to the printing unit and the non-overlapping portion of a sheet with the overlapping portion being farther from the printing unit, and sets timing of ejecting ink when the printing unit starts printing the overlapping portion to be different from timing of ejecting ink when the printing unit starts printing the non-overlapping portion.

12. A printing apparatus comprising:

a printing unit including an ejection port surface provided with a plurality of ejection ports for ejecting ink arrayed in a predetermined direction;

a conveyance unit configured to convey a sheet in a direction intersecting with an array direction of the ejection ports and to convey a preceding sheet and a following sheet in such a manner that an overlapping portion where a trailing edge of the preceding sheet and a leading edge of the following sheet overlap each other is formed at a printing position facing the ejection port surface of the printing unit; and a control unit configured to control the printing unit such that in a case where the printing unit prints an image on the overlapping portion subsequently to the non-overlapping portion, the control unit causes the printing unit to eject ink onto the non-overlapping portion at a predetermined ejection cycle, and the control unit causes the printing unit to eject ink onto the overlapping portion at an interval greater than the predetermined ejection cycle after the printing unit ejects ink onto the non-overlapping portion.

13. The printing apparatus according to claim 12, further comprising:

an acquisition unit configured to acquire information about a type of each of the preceding sheet and the following sheet; and a determination unit configured to determine, based on the information acquired by the acquisition unit, an interval after the printing unit ejects ink onto the non-overlapping portion until the printing unit ejects ink onto the overlapping portion when the printing unit prints the overlapping portion subsequently to the non-overlapping portion, wherein the printing unit performs printing at the interval determined by the determination unit.

14. A printing method comprising:

conveying a preceding sheet and a following sheet in such a manner that an overlapping portion where a trailing edge of the preceding sheet and a leading edge of the following sheet overlap each other is formed; and ejecting ink onto a sheet and printing the sheet while moving a printing unit including an ejection port surface provided with a plurality of ejection ports for ejecting ink arrayed in a predetermined direction in a movement direction intersecting with the predetermined direction, wherein in a case where the overlapping portion of a sheet located closer to the ejection port surface at a position facing the ejection ports and a non-overlapping portion of one of the preceding sheet and the following sheet where the preceding sheet and the following sheet do not overlap each other are printed in a same movement of the printing unit, ink ejection timing according to the movement of the printing unit by a part of the plurality of ejection ports for printing the overlapping portion is delayed from ink ejection timing according to the movement of the printing unit by another part of the plurality of ejection ports for printing the non-overlapping portion.

15. The printing method according to claim 14, wherein a length of the overlapping portion formed in a conveyance direction is changed based on image data on one of the preceding sheet and the following sheet, and ink ejection timing of the printing unit is changed at a position corresponding to the length.

16. The printing method according to claim 14, wherein information about a type of each of the preceding sheet and the following sheet is acquired, and a degree of delaying ink ejection timing according to the movement of the printing unit when the printing unit prints the overlapping portion from ink ejection timing according to the movement of the printing unit when the printing unit prints the non-overlapping portion is determined based on the acquired information.

17. The printing method according to claim 16, wherein, based the acquired information, in a case where a thickness of the preceding sheet and the following sheet is greater than or equal to a predetermined thickness, the ink ejection timing according to the movement of the printing unit when the printing unit prints the overlapping portion is delayed from the ink ejection timing according to the movement of the printing unit when the printing unit prints the non-overlapping portion, and in a case where the thickness of the preceding sheet and the following sheet is smaller than the predetermined thickness, the ink ejection timing is maintained to match the ink ejection timing according to the movement of the printing unit when the printing unit prints the overlapping portion with the ink ejection timing according to the movement of the printing unit when the printing unit prints the non-overlapping portion.

18. The printing method according to claim 14, wherein timing of ejecting ink onto the overlapping portion is corrected to be later than reference timing of ejecting ink onto the non-overlapping portion.

19. A printing method comprising:

conveying a preceding sheet and a following sheet in such a manner that an overlapping portion where a trailing edge of the preceding sheet and a leading edge of the following sheet overlap each other is formed; and ejecting ink from a printing unit including a plurality of ejection ports arrayed in a predetermined direction onto the preceding sheet and the following sheet conveyed in a direction intersecting with the predetermined direction and printing the preceding sheet and the following sheet, wherein in printing an image on the overlapping portion subsequently to a non-overlapping portion where the trailing edge of the preceding sheet and the leading edge of the following sheet do not overlap each other by the printing unit, ejecting ink onto the non-overlapping portion at a predetermined ejection cycle, and the printing unit ejects ink onto the overlapping portion at an interval greater than the predetermined ejection cycle after the printing unit ejects ink onto the non-overlapping portion.

20. The printing method according to claim 19, wherein information about a type of each of the preceding sheet and the following sheet is acquired, wherein an interval after ink is ejected onto the non-overlapping portion until ink is ejected onto the overlapping portion is determined based on the acquired information, and wherein the printing unit prints the overlapping portion subsequently to the non-overlapping portion at the determined interval.

* * * * *